US009084323B2

(12) United States Patent
Yang

(10) Patent No.: US 9,084,323 B2
(45) Date of Patent: Jul. 14, 2015

(54) APPARATUS AND METHOD FOR DRIVING LED

(71) Applicant: Samsung Electro-Mechanics Co., Ltd., Suwon-Si, Gyeonggi-Do (KR)

(72) Inventor: Chin Tae Yang, Suwon-Si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/294,856

(22) Filed: Jun. 3, 2014

(65) Prior Publication Data

US 2015/0115820 A1 Apr. 30, 2015

(30) Foreign Application Priority Data

Oct. 31, 2013 (KR) ..... 10-2013-0131163

(51) Int. Cl.
*H05B 33/08* (2006.01)

(52) U.S. Cl.
CPC ..... *H05B 33/083* (2013.01)

(58) Field of Classification Search
CPC ..... H05B 33/083; H05B 33/0824
USPC ..... 315/193, 294, 297
See application file for complete search history.

(56) References Cited

U.S. PATENT DOCUMENTS

| | | | | |
|---|---|---|---|---|
| 6,989,807 | B2 | 1/2006 | Chiang | |
| 2004/0233145 | A1 | 11/2004 | Chiang | |
| 2011/0084618 | A1* | 4/2011 | Kang et al. | 315/185 R |
| 2011/0181194 | A1* | 7/2011 | Hum et al. | 315/186 |
| 2012/0194088 | A1* | 8/2012 | Pan | 315/193 |
| 2013/0026931 | A1* | 1/2013 | Jong et al. | 315/186 |
| 2014/0125235 | A1* | 5/2014 | van den Berg et al. | 315/185 R |
| 2014/0306614 | A1* | 10/2014 | Pan | 315/193 |
| 2014/0375224 | A1* | 12/2014 | Jung | 315/193 |

FOREIGN PATENT DOCUMENTS

| | | | |
|---|---|---|---|
| JP | 2011-171116 | A | 9/2011 |
| KR | 10-1205121 | B1 | 11/2012 |

* cited by examiner

*Primary Examiner* — Don Le
(74) *Attorney, Agent, or Firm* — McDermott Will & Emery LLP

(57) ABSTRACT

A light emitting diode (LED) driving apparatus may include: a rectifying unit providing a rectified voltage; an LED array including at least one LED string including first to nth LEDs connected in series; a sink path controller providing first to (n−1)th sink path control signals according to a level of the rectified voltage; a sink path switching circuit unit including first to (n−1)th sink path switches performing a switching operation according to each of the first to (n−1)th sink path control signals; a voltage phase controller generating a phase-adjusted voltage; a source path controller providing first to (n−1)th source path control signals; and a source path switching circuit unit including first to (n−1)th source path switches performing a switching operation according to each of the first to (n−1)th source path control signals.

20 Claims, 17 Drawing Sheets

APPARATUS AND METHOD FOR DRIVING LED

CROSS-REFERENCE TO RELATED APPLICATION

This application claims the benefit of Korean Patent Application No. 10-2013-0131163 filed on Oct. 31, 2013, with the Korean Intellectual Property Office, the disclosure of which is incorporated herein by reference.

BACKGROUND

The present disclosure relates to an apparatus and method for driving a light emitting diode (LED) using alternating current (AC) power.

In general, unlike conventional lighting devices such as incandescent lamps, fluorescent lamps, and the like, LEDs are known to have a high enough degree of efficiency to allow for energy savings of up to 90%.

Due to the inherent advantages of LEDs, LEDs have been increasingly replacing existing light sources even in fields other than lighting.

In general, an apparatus for driving an LED (or an LED driving apparatus) may include a rectifying circuit converting alternating current (AC) power into a direct current (DC) voltage, a smoothing capacitor, an AC/DC converter, a DC/DC converter converting a DC voltage into a DC voltage, and the like.

LED driving apparatuses require a large amount of components and circuits, disadvantageously complicating designs and increasing manufacturing costs thereof. Also, electrolytic capacitors having large capacities are commonly used as smoothing capacitors, but the use of electrolytic capacitors having large capacities for long periods of time increases equivalent series resistance (ESR) to increase loss, resulting in a degradation of efficiency over a duration of usage.

Meanwhile, recently, designs, research, and applications of LED driving circuits for driving LEDs using voltages output from rectifying circuits have continued to increase.

LED driving circuits use a full-wave rectified voltage, and here, a waveform of a full-wave rectified voltage is gradually increased from a zero voltage and gradually reduced to be returned to the zero voltage, repeatedly.

For example, when a 60 Hz AC is full-wave rectified, a voltage having a full-wave rectified waveform having a 120 Hz frequency is generated, and when an LED is driven by using such a voltage having a 120 Hz frequency, zero voltages are repeated 120 times per second, and accordingly, the LED is turned off and on 120 times per second. Namely, in an LED array, a valley fill section, in which all LEDs are turned off, exists, resulting in the occurrence of a flicker phenomenon in which LEDs flicker 120 times in one second.

Thus, in the case of driving LEDs using a rectified voltage, a solution to flickering, as mentioned above, needs to be provided.

Patent Document 1 does not disclose a technical matter of solving shortcomings of flickering occurring when LEDs are directly driven.

RELATED ART DOCUMENT (Patent Document 1) U.S. Patent Laid-Open Publication No. U.S. Pat. No. 6,989,807

SUMMARY

An aspect of the present disclosure may provide an apparatus and method for driving a light emitting diode (LED) capable of solving flickering occurring when LEDs are driven using a rectified voltage.

According to a first aspect of the present disclosure, a light emitting diode (LED) driving apparatus may include: a rectifying unit rectifying an alternating current (AC) voltage to provide a rectified voltage; an LED array including at least one LED string connected to an output terminal of the rectifying unit, the LED string including first to nth LEDs connected in series; a sink path controller providing first to (n−1)th sink path control signals according to a level of the rectified voltage; a sink path switching circuit unit including first to (n−1)th sink path switches respectively connected to cathodes of the first to (n−1)th LEDs and a ground, each of the first to (n−1)th sink path switches performing a switching operation according to each of the first to (n−1)th sink path control signals to change a closed circuit path; a voltage phase controller generating a phase-adjusted voltage having a phase different from that of the rectified voltage; a source path controller providing first to (n−1)th source path control signals according to a level of the phase-adjusted voltage; and a source path switching circuit unit including first to (n−1)th source path switches respectively connected between anodes of the second to nth LEDs and a phase-adjusted voltage terminal of the voltage phase controller, each of the first to (n−1)th source path switches performing a switching operation according to each of the first to (n−1)th source path control signals to change a closed circuit path.

In the first aspect of the present disclosure, when the sink path controller provides the ith sink path control signal (i is a natural number between 1 to n−1) as an ON signal, the source path controller may provide the ith source path control signal as an OFF signal and a (i+1)th source path control signal as an ON signal.

According to a second aspect of the present disclosure, a light emitting diode (LED) driving apparatus may include: a rectifying unit rectifying an alternating current (AC) voltage to provide a rectified voltage; an LED array including at least one LED string connected to an output terminal of the rectifying unit, the LED string including first to nth LEDs connected in series; a sink path controller detecting a level of the rectified voltage and providing first to (n−1)th sink path control signals according to the level of the rectified voltage; a sink path switching circuit unit including first to (n−1)th sink path switches respectively connected to cathodes of the first to (n−1)th LEDs and a ground, each of the first to (n−1)th sink path switches performing a switching operation according to each of the first to (n−1)th sink path control signals to change a closed circuit path; a voltage phase controller adjusting a phase of the rectified voltage to provide a phase-adjusted voltage; a source path controller detecting a level of the phase-adjusted voltage from the voltage phase controller and providing first to (n−1)th source path control signals according to the level of the phase-adjusted voltage; and a source path switching circuit unit including first to (n−1)th source path switches respectively connected between anodes of the second to nth LEDs and a phase-adjusted voltage terminal of the voltage phase controller, each of the first to (n−1)th source path switches performing a switching operation according to each of the first to (n−1)th source path control signals to change a closed circuit path, wherein the rectifying unit forms a closed circuit with the first to (n−1)th LEDs and the voltage phase controller forms a closed circuit with the second to nth LEDs, and when the ith sink path switch is switched on to turn on the ith LED among the first to (n−1)th LEDs, an (i+1)th source path switch is switched on to turn on an (i+2)th to nth LEDs.

In the first and second aspects of the present disclosure, as the level of the rectified voltage is increased, the first to (n−1)th sink path switches may be changed to be switched on one by one in a direction from the first sink path switch toward the (n−1)th sink path switch, and as the level of the rectified voltage is redecreased, the first to (n−1)th sink path switches may be changed to be switched off one by one in a direction from the (n−1)th sink path switch toward the first sink path switch.

As the level of the phase-adjusted voltage from the voltage phase controller is increased, the first to (n−1)th source path switches may be changed to be switched on one by one in a direction from the (n−1)th source path switch toward the first source path switch, and as the level of the phase-adjusted voltage of the voltage phase controller is redecreased, the first to (n−1)th source path switches may be changed to be switched off one by one in a direction from the first source path switch toward the (n−1)th source path switch.

According to a third aspect of the present disclosure, a method of driving a light emitting diode (LED) array including at least one LED string connected to an output terminal of a rectifying unit providing a rectified voltage, the LED string including first to nth LEDs connected in series, may include: a first operation in which, as a level of the rectified voltage is gradually increased, a sink path controller controls a sink path switching circuit to sequentially turn on the first to (n−1)th LEDs one by one; a second operation in which, as the level of the rectified voltage is gradually decreased, the sink path controller controls the sink path switching circuit unit to sequentially turn off the (n−1)th to first LEDs one by one, during which, as the level of the rectified voltage is gradually decreased, a level of a phase-adjusted voltage is gradually increased, and as the level of the phase-adjusted voltage is gradually increased, a source path controller controls a source path switching circuit unit to sequentially turn on the turned-off nth to second LEDs one by one; a third operation in which, as the level of the rectified voltage is gradually increased, the level of the phase-adjusted voltage is gradually decreased, and as the level of the phase-adjusted voltage is gradually lowered, the source path controller controls the source path switching circuit unit to sequentially turn off the second to nth LEDs one by one, during which, as the level of the rectified voltage is gradually reincreased, the sink path controller controls the sink path switching circuit unit to sequentially turn on the turned-off first to (n−1)th LEDs one by one; and a fourth operation in which when power is separated, the process is terminated, and in the case that power is not separated, the process is returned to the second operation, and second and third operations are repeatedly performed.

In the third aspect of the present disclosure, in the first operation, as the level of the rectified voltage is gradually increased, the sink path controller may control the first to (n−1)th sink path switches included in the sink path switching circuit unit to be switched on one by one in a direction from the first sink path switch toward the (n−1)th sink path switch.

In the second operation, as the level of the rectified voltage is gradually decreased, the sink path controller may control the first to (n−1)th sink path switches included in the sink path switching circuit unit to be sequentially switched off in a direction from the (n−1)th sink path switch toward the first sink path switch, during which, as the level of the phase-adjusted voltage is gradually increased, the source path controller may control the first to (n−1)th source path switches included in the source path switching circuit unit to be switched on one by one in a direction from the (n−1) source path switch toward the first source path switch.

In the third operation, as the level of the phase-adjusted voltage is gradually decreased, the source path controller may control the first to (n−1)th source path switches included in the source path switching circuit unit to be switched off one by one in a direction from the first source path switch toward the (n−1)th source path switch, during which, as the level of the rectified voltage is gradually reincreased, the sink path controller may control the first to (n−1)th sink path switches included in the sink path switching circuit unit to be switched on one by one in a direction from the first sink path switch toward the (n−1)th sink path switch.

According to a fourth aspect of the present disclosure, a method of driving a light emitting diode (LED) array including at least one LED string connected to an output terminal of a rectifying unit providing a rectified voltage, the LED string including first to nth LEDs connected in series, may include: generating, by a voltage phase controller, a phase-adjusted voltage having a phase different from that of the rectified voltage; detecting, by a sink path controller, a level of the rectified voltage and providing first to (n−1)th sink path control signals according to the level of the rectified voltage; detecting, by a source path controller, a level of the phase-adjusted voltage from the voltage phase controller and providing first to (n−1)th source path control signals according to the level of the phase-adjusted voltage; and switching on or off first to (n−1)th sink path switches included in a sink path switching circuit unit and respectively connected between cathodes of the first to (n−1)th LEDs and a ground, according to the first to (n−1)th sink path control signals, respectively, to control a sink path, and switching on or off first to (n−1)th source path switches included in a source path switching circuit unit and respectively connected between anodes of the second to nth LEDs and a phase-adjusted voltage terminal of the voltage phase controller, according to the first to (n−1)th source path control signals, respectively, to control a source path.

In the fourth aspect of the present disclosure, in the controlling of the sink and source paths, when the sink path controller provides the ith sink path control signal 9*i* is a natural number between 1 to n−1) as an ON signal, the source path controller may provide the ith source path control signal as an OFF signal and an (i+1)th source path control signal as an ON signal.

In the controlling of the sink and source paths, when the ith sink path switch is switched on to turn on the first to ith LEDs, among the first to (n−1)th LEDs, the (i+1)th source path switch may be switched on to turn on the (i+2)th to nth LEDs.

According to a fifth aspect of the present disclosure, a method of driving a light emitting diode (LED) array including at least one LED string connected to an output terminal of a rectifying unit providing a rectified voltage, the LED string including first to nth LEDs connected in series, may include: generating, by a voltage phase controller, a phase-adjusted voltage having a phase different from that of the rectified voltage; detecting, by a sink path controller, a level of the rectified voltage and providing first to (n−1)th sink path control signals according to the level of the rectified voltage; detecting, by a source path controller, a level of the phase-adjusted voltage from the voltage phase controller and providing first to (n−1)th source path control signals according to the level of the phase-adjusted voltage; and switching on or off first to (n−1)th sink path switches included in a sink path switching circuit unit and respectively connected between cathodes of the first to (n−1)th LEDs and a ground, according to the first to (n−1)th sink path control signals, respectively, to control a sink path, and switching on or off first to (n−1)th source path switches included in a source path switching circuit unit and respectively connected between anodes of the second to nth LEDs and a phase-adjusted voltage terminal of the voltage phase controller, according to the first to (n−1)th source path control signals, respectively, to control a source path, wherein when the ith sink path switch (i is a natural number between 1 to n−1) connected to a cathode of the ith LED among the first to (n−1)th LEDs is changed to be switched on, the (I+1)th source path switch may be changed to be switched on.

In the fourth and fifth aspects of the present disclosure, in the controlling of the sink and source paths, as the level of the rectified voltage is increased, the first to (n−1)th sink path switches may be changed to be switched on one by one in a direction from the first sink path switch toward the (n−1)th sink path switch, and as the level of the rectified voltage is redecreased, the first to (n−1)th sink path switches may be changed to be switched on one by one in a direction from the (n−1)th sink path switch toward the first sink path switch.

In the controlling of the sink and source paths, as the level of the phase-adjusted voltage from the voltage phase controller is increased, the first to (n−1)th source path switches may be changed to be switched on one by one in a direction from the (n−1)th source path switch toward the first source path switch, and as the level of the phase-adjusted voltage from the voltage phase controller is redecreased, the first to (n−1)th source path switches may be changed to be switched on in a direction from the first source path switch toward the (n−1)th source path switch.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
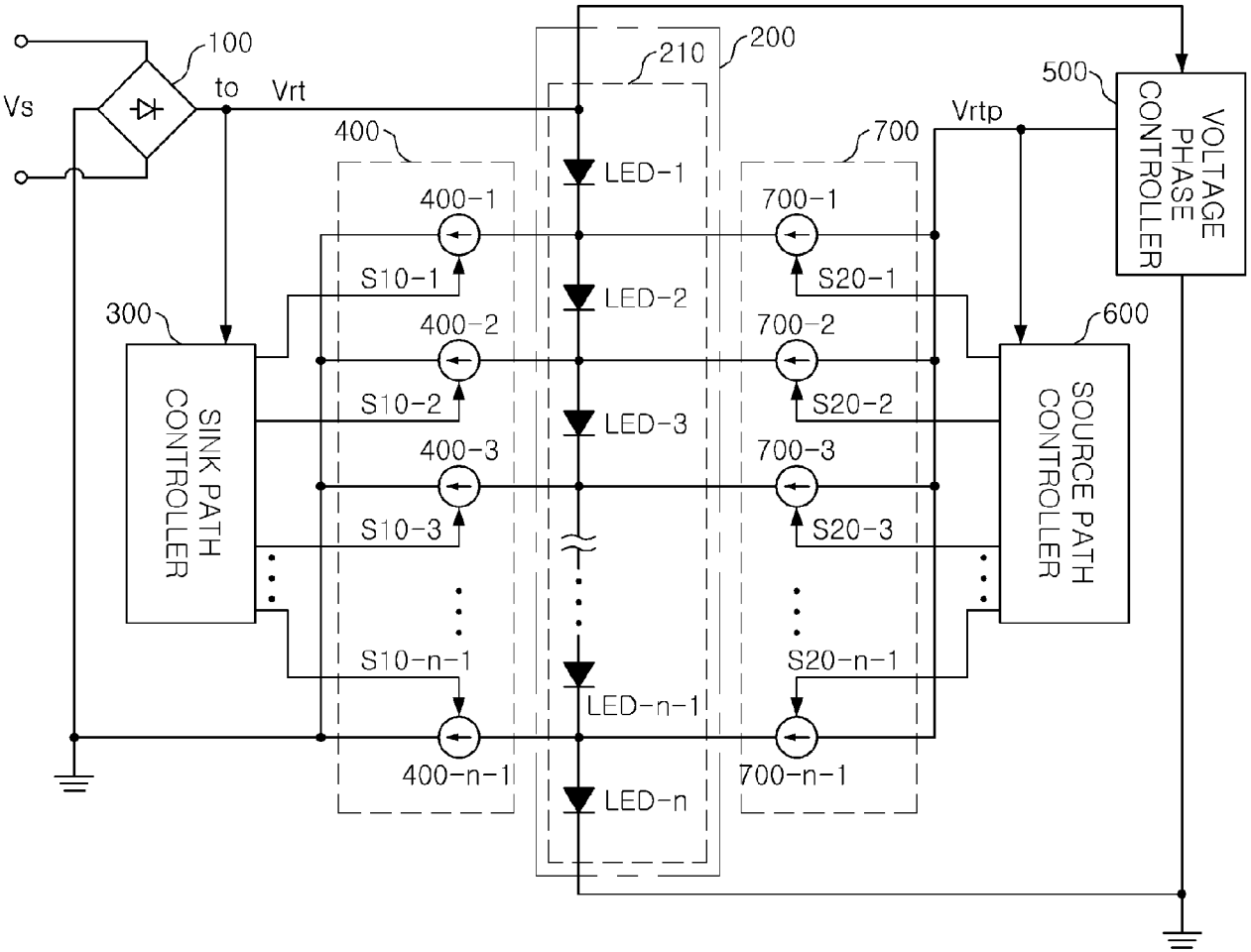
FIG. 1 is a circuit diagram of an LED driving apparatus according to an exemplary embodiment of the present disclosure.

Hereinafter, exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

FIG. 1 is a circuit diagram of an LED driving apparatus according to an exemplary embodiment of the present disclosure;

Referring to FIG. 1, an LED driving apparatus according to an exemplary embodiment of the present disclosure may include a rectifying unit 100, an LED array 200, a sink path controller 300, a sink path switching circuit unit 400, a voltage phase controller 500, a source path controller 600, and a source path switching circuit unit 700.

The rectifying unit 100 may rectify an alternating current (AC) voltage to provide a rectified voltage Vrt. In this case, the rectified voltage Vrt may be a full-wave rectified pulsating voltage. For example, when a 60 Hz AC voltage is full-wave rectified, it may become a 120 Hz pulsating voltage.

The LED array 200 may include at least one LED string 210 connected to an output terminal of the rectifying unit 100, and the LED string 210 may include first to nth LEDs LED-1 to LED-n connected in series. Here, n is a natural number equal to or greater than 2.

The sink path controller 300 may detect a level of the rectified voltage Vrt of the rectifying unit 100 and provide first to (n−1)th sink path control signals S10-1 to S10-n-1 according to the level of the rectified voltage Vrt.

Here, the first to (n−1)th sink path control signals S10-1 to S10-n-1 may all be switching OFF signals or one thereof may be a switching ON signal having a high level.

Also, as the level of the rectified voltage Vrt is increased, the first to (n−1)th sink path control signals S10-1 to S10-n-1 may be changed to switching ON signals in a direction from the first sink path control signal S10-1 toward the (n−1)th sink path control signal S10-n-1. For example, in a case in which the level of the rectified voltage Vrt is increased in stages, the first sink path control signal S10-1 may be changed to a switching ON signal, the second sink path control signal S10-2 may subsequently be changed to a switching ON signal, and, in this manner, the (n−1)th sink path control signal S10-n-1 may eventually be changed to a switching ON signal.

The sink path switching circuit unit 400 may include first to (n−1)th sink path switches 400-1 to 400-n-1 respectively connected between cathodes of the first to (n−1)th LEDs LED-1 to LED-n-1 and a ground.

The first to (n−1)th sink path switches 400-1 to 400-n-1 may respectively be switched on or off according to the first to (n−1)th sink path control signals S10-1 to S10-n-1. For example, when the level of the rectified voltage Vrt is a zero voltage or a voltage corresponding thereto, all of the first to (n−1)th sink path switches 400-1 to 400-n-1 may be changed to be switched off, or in a case in which the level of the rectified voltage Vrt is equal to or higher than a single LED turn-on voltage, one of the first to (n−1)th sink path switches 400-1 to 400-n-1 may be switched on according to the level.

In this manner, each of the sink path switches included in the sink path switching circuit unit 400 may be installed in every cathode of the plurality of LEDs included in the LED string 210. Alternately, a sink path switch may be disposed in alternate LEDs or disposed at intervals of two or more LEDs. For example, a single sink path switch may be installed in every two LEDs.

The voltage phase controller 500 may provide a phase-adjusted voltage Vrtp different from that of the rectified voltage Vrt from the rectifying unit 100.

For example, the voltage phase controller 500 may change a phase of the rectified voltage Vrt to provide the phase-adjusted voltage Vrtp. In this case, the voltage phase controller 500 may include an element or circuit for changing the phase.

In another example, the voltage phase controller 500 may include a circuit for generating the phase-adjusted voltage Vrtp having a phase different from that of the rectified voltage Vrt using phase information of the rectified voltage Vrt.

The phase of the phase-adjusted voltage Vrtp may be determined according to an amount of LEDs included in the LED string 210, an amount of sink path switches, an amount of source path switches, and an amount of LEDs maintained in an OFF state among the LEDs included in the LED string.

Meanwhile, the rectifying unit 100 may form a closed circuit with the first to (n−1)th LEDs LED-1 to LED-n-1, and the voltage phase controller 500 may form a closed circuit with the second to nth LEDs LED-1 to LED-n.

The source path controller 600 may detect a level of the phase-adjusted voltage Vrtp from the voltage phase controller 500 and provide first to (n−1)th source path control signals S20-1 to S20-n-1 according to the level of the phase-adjusted voltage.

Here, all of the first to (n−1)th source path control signals S20-1 to S20-n-1 may be changed to switching OFF signals or one thereof may be changed to a switching ON signal having a high level.

Also, as the level of the phase-adjusted voltage Vrtp is increased, the first to (n−1)th source path control signals S20-1 to S20-n-1 may be changed to switching ON signals in a direction from the (n−1)th source path control signal S20-n-1 toward the first source path control signal S20-1. For example, when the level of the phase-adjusted voltage Vrtp is increased in stages, the (n−1)th source path control signal S20-n-1 may be changed to a switching ON signal, the (n−2)th source path control signal S20-n-2 may subsequently be changed to a switching ON signal, and, in this manner, the first source path control signal S20-1 may eventually be changed to a switching ON signal.

The source path switching circuit unit 700 may include first to (n−1)th source path switches 700-1 to 700-1-n respectively connected between anodes of the second to nth LEDs LED-2 to LED-n and a phase-controlled voltage Vrtp terminal of the voltage phase controller 500.

The first to (n−1)th source path switches 700-1 to 700-1-n may respectively be switched on or off according to the first to (n−1)th source path control signals S20-1 to S20-n-1.

For example, in a case in which a level of the phase-adjusted voltage is a zero voltage or a voltage corresponding thereto, all of the first to (n−1)th source path switches 700-1 to 700-1-n may be changed to be switched off, or in a case in which a level of the phase-adjusted voltage is equal to or higher than a single LED turn-on voltage, one of the first to (n−1)th source path switches 700-1 to 700-1-n may be switched on according to the level.

As described above, when the sink path controller 300 provides the ith sink path control signal S10-i (i is a natural number between 1 to n−1) as an ON signal, the source path controller 600 may provide the ith source control signal S20-i as an OFF signal and a (i+1)th source path control signal S20-i+1 as an ON signal.

Accordingly, when the ith sink path switch 400-i is changed to be switched on, the ith source path switch 700-i may be changed to be switched off and the (i+1)th source path switch 700-i+1 may be changed to be switched on.

Subsequently, when the ith sink path switch 400-i is switched on to turn on the first to ith LEDs LED-1 to LED-i, among the (n−1)th LEDs LED-1 to LED-n-1, the (i+1)th source path switch 700-i+1 is switched on to turn on the (i+2)th to nth LEDs LED-i+2 to LED-n.

As a level of the rectified voltage from the rectifying unit 100 is increased, the first to (n−1)th sink path switches 400-1 to 400-n-1 may be changed to be switched on one by one in a direction from the first sink path switch 400-1 toward the (n−1)th sink path switch 400-n-1.

Also, as the level of the rectified voltage from the rectifying unit 100 is redecreased, the first to (n−1)th sink path switches 400-1 to 400-n-1 may be changed to be switched off one by one in a direction from the (n−1)th sink path switch 400-n-1 toward the first sink path switch 400-1.

As a level of the phase-adjusted voltage Vrtp from the voltage phase controller 500 is increased, the first to (n−1)th source path switches 700-1 to 700-n-1 may be changed to be switched on one by one in a direction from the (n−1)th source path switch 700-n-1 toward the first source path switch 700-1.

Also, as the level of the phase-adjusted voltage Vrtp from the voltage phase controller 500 is redecreased, the first to (n−1)th source path switches 700-1 to 700-n-1 may be changed to be switched off one by one in a direction from the first source path switch 700-1 toward the (n−1)th source path switch 700-n-1.

In this manner, each of the source path switches included in the source path switching circuit unit 700 may be installed in every anode of the plurality of LEDs included in the LED string 210. Alternately, a source path switch may be disposed in alternate LEDs or disposed at intervals of two or more LEDs. For example, a single source path switch may be installed in every two LEDs.

Figure 2:
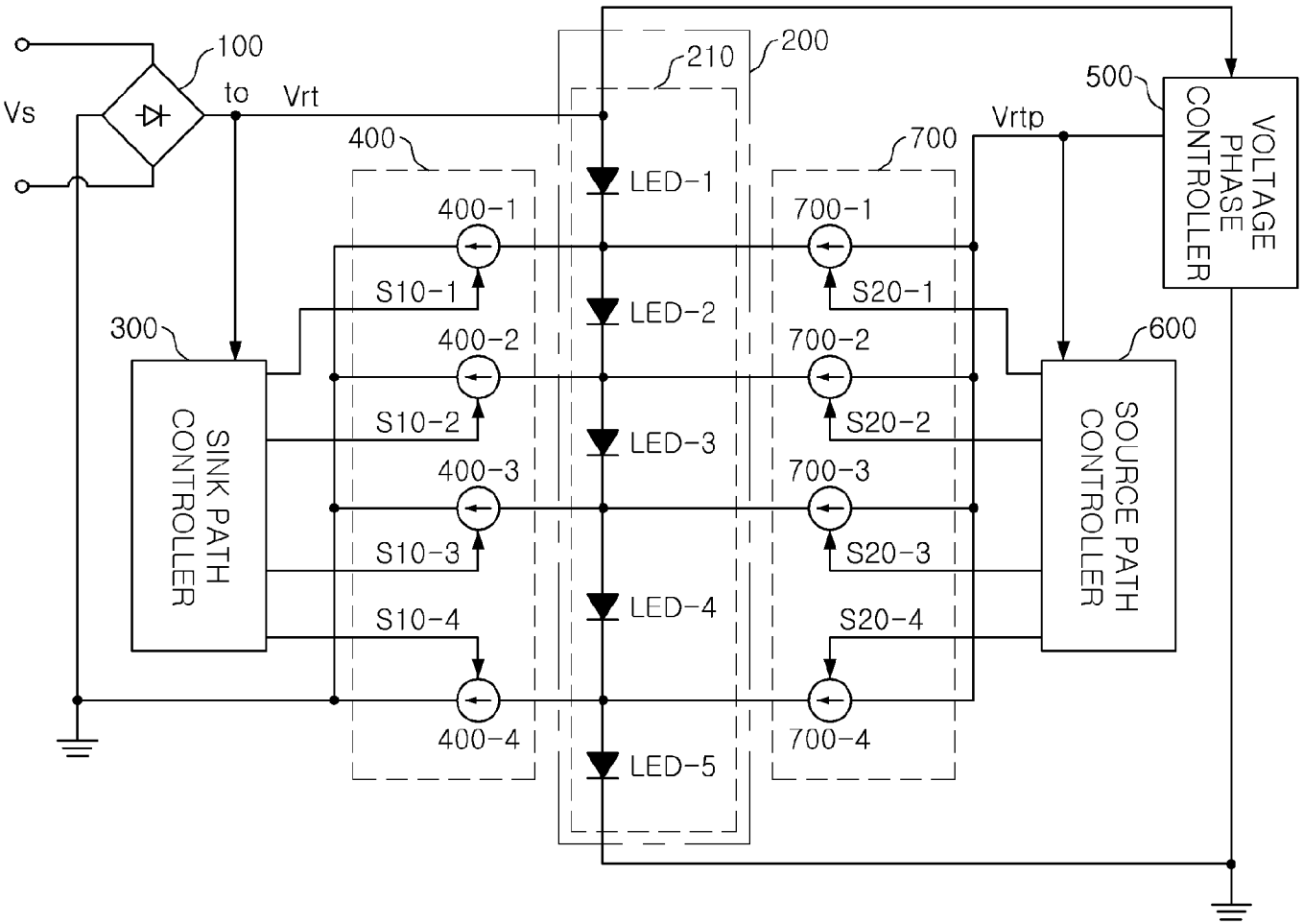
FIG. 2 is a circuit diagram illustrating an implemented example of an LED driving apparatus according to an exemplary embodiment of the present disclosure.

FIG. 2 is a circuit diagram illustrating an implemented example of an LED driving apparatus according to an exemplary embodiment of the present disclosure. Referring to FIGS. 1 and 2, the LED driving apparatus according to the exemplary embodiment of the present disclosure may include a rectifying unit 100, an LED array 200, a sink path controller 300, a sink path switching circuit unit 400, a voltage phase controller 500, a source path controller 600, and a source path switching circuit unit 700.

As for operations of the LED driving apparatus of FIG. 2, redundant descriptions of operations described above with reference to FIG. 1 will be omitted.

The LED driving apparatus of FIG. 2 is different from that of FIG. 1, in that an LED string 210 of the LED array 200 includes first to fifth LEDs LED-1 to LED-5. However, this is for the purposes of description of the LED driving apparatus and the present disclosure is not limited thereto.

Thus, the rectifying unit 100 may form a closed circuit with the first to fourth LEDs LED-1 to LED-4 and the voltage phase controller 500 may form a closed circuit with the second to fifth LEDs LED-1 to LED-5.

The sink path controller 300 may provide first to fourth sink path control signals S10-1 to S10-4 according to a level of a rectified voltage Vrt.

The sink path switching circuit unit 400 may include first to fourth sink path switches 400-1 to 400-4 respectively connected between cathodes of the first to fourth LEDs LED-1 to LED-4 and a ground. The first to fourth sink path switches 400-1 to 400-4 may respectively be switched on or off according to the first to fourth sink path control signals S10-1 to S10-4.

The source path controller 600 may provide first to fourth source path control signals S20-1 to S20-4 according to a level of the phase-adjusted voltage.

The source path switching circuit unit 700 may include first to fourth source path switches 700-1 to 700-4 respectively connected between anodes of the second to fifth LEDs LED-2 to LED-5 and a phase-controlled voltage Vrtp terminal of the voltage phase controller 500. The first to fourth source path switches 700-1 to 700-4 may respectively be switched on or off according to the first to fourth source path control signals S20-1 to S20-4.

As a level of the rectified voltage from the rectifying unit 100 is increased, the first to fourth sink path switches 400-1 to 400-4 may be changed to be switched on one by one in a direction from the first sink path switch 400-1 toward the fourth sink path switch 400-4.

Also, as the level of the rectified voltage from the rectifying unit 100 is redecreased, the first to fourth sink path switches 400-1 to 400-4 may be changed to be switched off one by one in a direction from the fourth sink path switch 400-4 toward the first sink path switch 400-1.

As a level of the phase-adjusted voltage Vrtp from the voltage phase controller 500 is increased, the first to fourth source path switches 700-1 to 700-4 may be changed to be switched on one by one in a direction from the fourth source path switch 700-4 toward the first source path switch 700-1.

Also, as the level of the phase-adjusted voltage Vrtp from the voltage phase controller 500 is redecreased, the first to fourth source path switches 700-1 to 700-4 may be changed to be switched off one by one in a direction from the first source path switch 700-1 toward the fourth source path switch 700-4.

Figure 3:
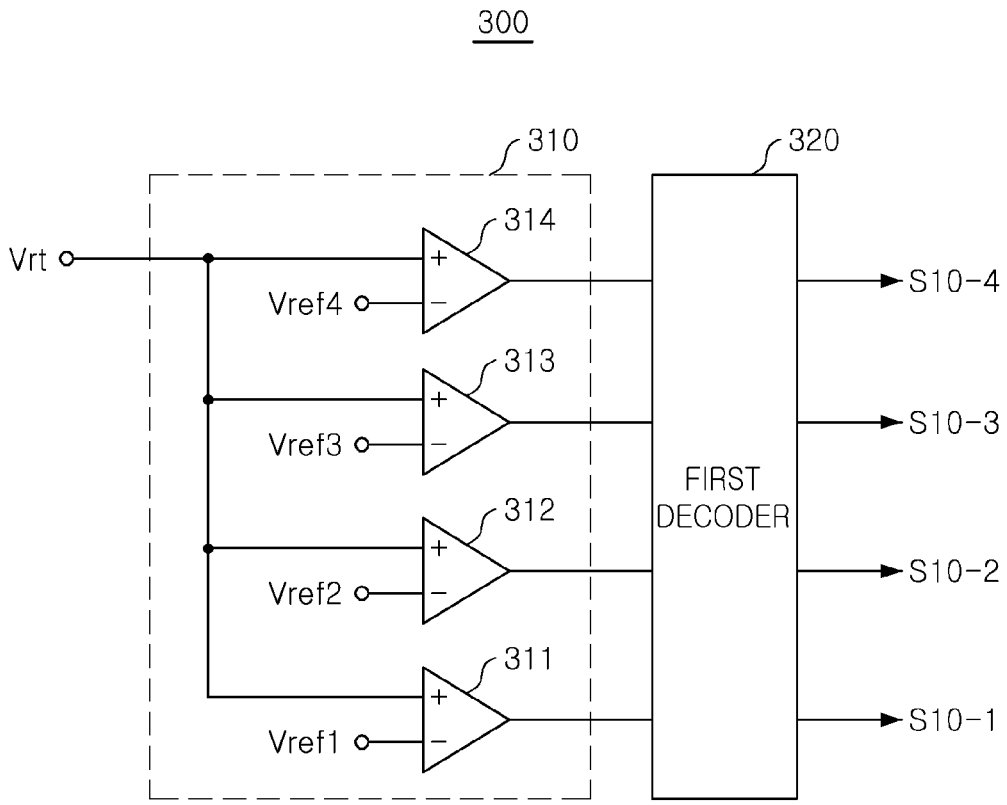
FIG. 3 is a circuit diagram illustrating an implemented example of a sink path controller according to an exemplary embodiment of the present disclosure.

FIG. 3 is a circuit diagram illustrating an implemented example of a sink path controller according to an exemplary embodiment of the present disclosure.

Referring to FIGS. 2 and 3, a sink path controller 300 may include a first comparing unit 310 having first to fourth sink comparators 311 to 314 and a first decoder 320.

The first sink comparator 311 may compare the rectified voltage Vrt with a pre-set first reference voltage Vref and provide a signal having a logic state in accordance with the comparison result.

The second sink comparator 312 may compare the rectified voltage Vrt with a second reference voltage Vref2 set to be higher than the first reference voltage Vref1 and provide a signal having a logic state in accordance with the comparison result.

The third sink comparator 313 may compare the rectified voltage Vrt with a third reference voltage Vref3 set to be higher than the second reference voltage Vref2 and provide a signal having a logic state in accordance with the comparison result.

The fourth sink comparator 314 may compare the rectified voltage Vrt with a fourth reference voltage Vref4 set to be higher than the third reference voltage Vref3 and provide a signal having a logic state in accordance with the comparison result.

The first decoder 320 may decode signals from the first to fourth sink comparators 311 to 314 and provide first to fourth sink path control signals S10-1 to S10-4.

For example, when only a signal from the first sink comparator 311, among the first to fourth sink comparators 311 to 314, has a high level, only the first sink path control signal S10-1 may be provided as an ON signal. When only a signal from the second sink comparator 311, among the first to fourth sink comparators 311 to 314, has a high level, only the second sink path control signal S10-2 may be provided as an ON signal. When only a signal from the third sink comparator 313, among the first to fourth sink comparators 311 to 314, has a high level, only the third sink path control signal S10-3 may be provided as an ON signal. When only a signal from the fourth sink comparator 314, among the first to fourth sink comparators 311 to 314, has a high level, only the fourth sink path control signal S10-4 may be provided as an ON signal.

For example, in a case in which the rectified voltage Vrt is changed within a voltage range from 0V to a peak voltage 311V (Vrms=220V), the first, second, third, and fourth reference voltages Vref1, Vref2, Vref3, and Vref4 may be 75V, 150V, 225V, and 300V, respectively. When the rectified voltage Vrt is lower than 75V, all of the first to fourth sink path control signals S10-1 to S10-4 may be changed to OFF signals. When the rectified voltage Vrt is equal to or higher than 75V and lower than 150V, the first sink path control signal S10-1 may be changed to an ON signal. When the rectified voltage Vrt is equal to or higher than 150V and lower than 225V, the second sink path control signal S10-2 may be changed to an ON signal. When the rectified voltage Vrt is equal to or higher than 225V and lower than 300V, the third sink path control signal S10-3 may be changed to ON signal. When the rectified voltage Vrt is equal to or higher than 300V and lower than 5V, the fourth sink path control signal S10-4 may be changed to an ON signal.

Figure 4:
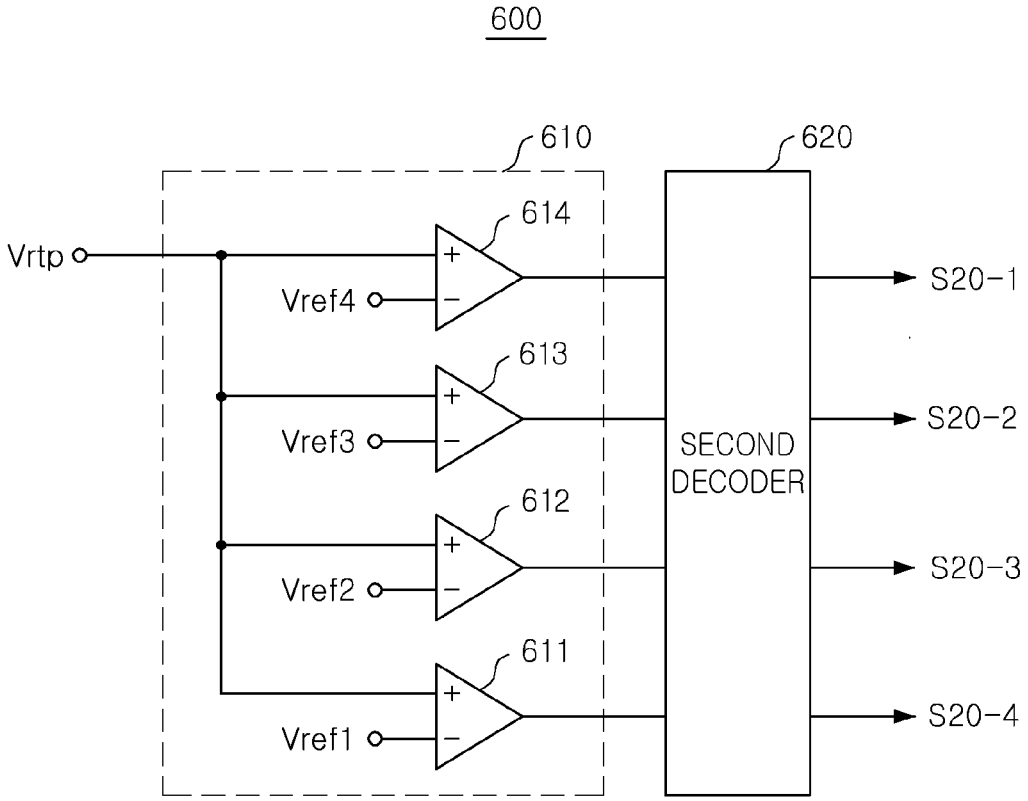
FIG. 4 is a circuit diagram illustrating an implemented example of a source path controller according to an exemplary embodiment of the present disclosure.

FIG. 4 is a circuit diagram illustrating an implemented example of a source path controller according to an exemplary embodiment of the present disclosure.

Referring to FIGS. 2 and 4, the source path controller 600 may include a second comparing unit 610 having first to fourth source comparators 611 to 614 and a second decoder 620.

The first source comparator 611 may compare the phase-adjusted voltage Vrtp with a pre-set first reference voltage Vref1 and provide a signal having a logic state in accordance with the comparison result.

The second source comparator 612 may compare the phase-adjusted voltage Vrtp with a second reference voltage Vref2 set to be higher than the first reference voltage Vref1 and provide a signal having a logic state in accordance with the comparison result.

The third source comparator 613 may compare the phase-adjusted voltage Vrtp with a third reference voltage Vref3 set to be higher than the second reference voltage Vref2 and provide a signal having a logic state in accordance with the comparison result.

The fourth source comparator 614 may compare the phase-adjusted voltage Vrtp with a fourth reference voltage Vref4 set to be higher than the third reference voltage Vref3 and provide a signal having a logic state in accordance with the comparison result.

The second decoder 620 may decode signals from the first to fourth source comparators 611 to 614 and provide first to fourth source path control signals S20-1 to S20-4.

For example, when a signal from the first source comparator 611, among the first to fourth source comparators 611 to 614, has a high level, the second decoder 620 may provide only the fourth source path control signal 20-4 as an ON signal. When signals from the first and second source comparators 611 and 612 have a high level, the second decoder 620 may provide only the third source path control signal 20-3 as an ON signal. When signals from the first to third source comparators 611 to 613 have a high level, the second decoder 620 may provide only the second source path control signal S20-2 as an ON signal. Also, when signals from the first to fourth source comparators 611 to 614 have a high level, the second decoder 620 may provide only the first source path control signal S20-1 as an ON signal.

For example, as described above, in a case in which the rectified voltage Vrt is changed within a voltage range from 0V to 311V, the first, second, third, and fourth reference voltages Vref1, Vref2, Vref3, and Vref4 may be 75V, 150V, 225V, and 300V, respectively. When the rectified voltage Vrt is lower than 75V, all of the first to fourth source path control signals S20-1 to S20-4 may be changed to OFF signals. When the rectified voltage Vrt is equal to or higher than 75V and lower than 150V, the fourth source path control signal S20-4 may be changed to an ON signal. When the rectified voltage Vrt is equal to or higher than 150V and lower than 225V, the third source path control signal S20-3 may be changed to an ON signal. When the rectified voltage Vrt is equal to or higher than 225V and lower than 300V, the second source path control signal S20-2 may be changed to ON signal. When the rectified voltage Vrt is equal to or higher than 300V and lower than 5V, the first source path control signal S20-1 may be changed to an ON signal.

As described above, first, as the level of the rectified voltage Vrt is gradually increased, the sink path controller 300 may control the sink path switching circuit unit 400 to sequentially turn on the first to (n−1)th LEDs LED1 to LEDn−1 one by one.

Next, as the level of the rectified voltage Vrt is gradually decreased, the sink path controller 300 may control the sink path switching circuit unit 400 to sequentially turn off the (n−1)th to the first LEDs LEDn−1 to LED1 one by one. Here, as the level of the rectified voltage Vrt is gradually decreased, the level of the phase-adjusted voltage Vrtp is gradually increased, and as the level of the phase-adjusted voltage Vrtp is gradually increased, the source path controller 600 may control the source path switching circuit unit 700 to sequentially turn on the turned-off nth to second LEDs LEDn to LED2 one by one.

Thereafter, as the level of the rectified voltage Vrt is gradually increased, the level of the phase-adjusted voltage Vrtp is gradually decreased, and as the level of the phase-adjusted voltage Vrpt is gradually decreased, the source path controller 600 may control the source path switching circuit unit 700 to sequentially turn off the second to nth LEDs LED2 to LEDn one by one. Here, as the level of the rectified voltage Vrt is gradually reincreased, the sink path controller 300 may control the sink path switching circuit unit 400 to sequentially turn on the turned-off first to (n−1)th LEDs LED1 to LEDn−1 one by one.

When power is separated, the foregoing process may be terminated, and in the case that power is not separated, the foregoing process may be repeatedly performed. Examples of the operational process will be described with reference to FIGS. 5 through 14.

Figure 5A:
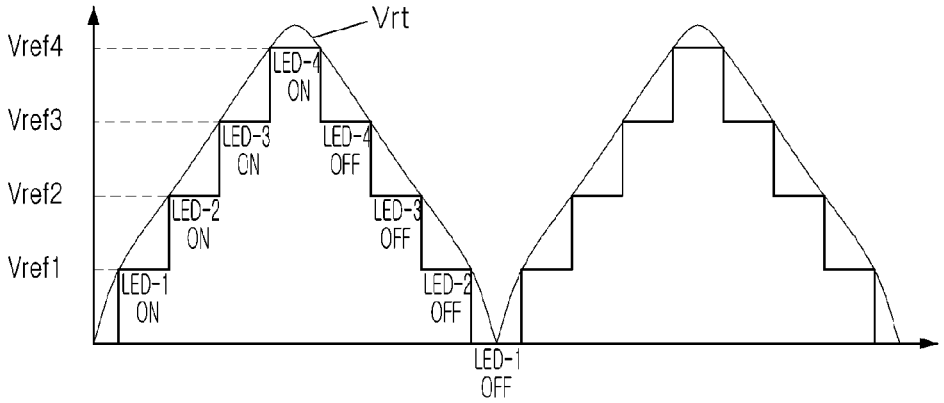
FIGS. 5A through 5C are views illustrating operations of an LED array of the LED driving apparatus according to an exemplary embodiment of the present disclosure.
Figure 5B:
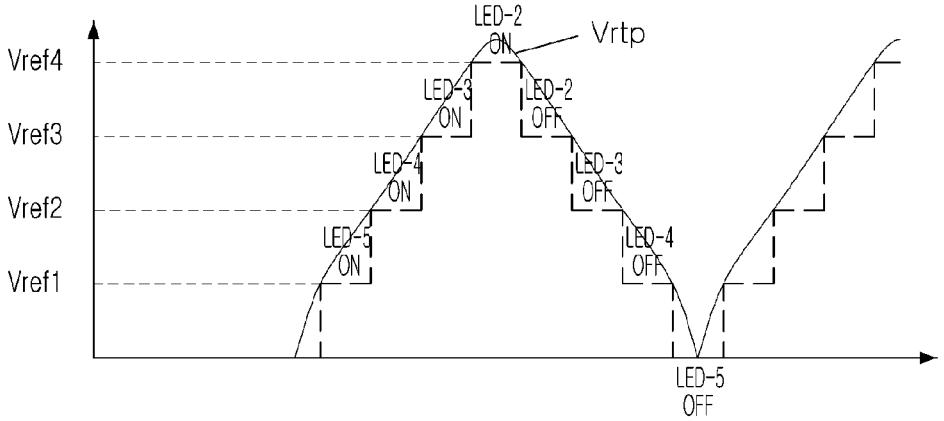
Figure 5C:
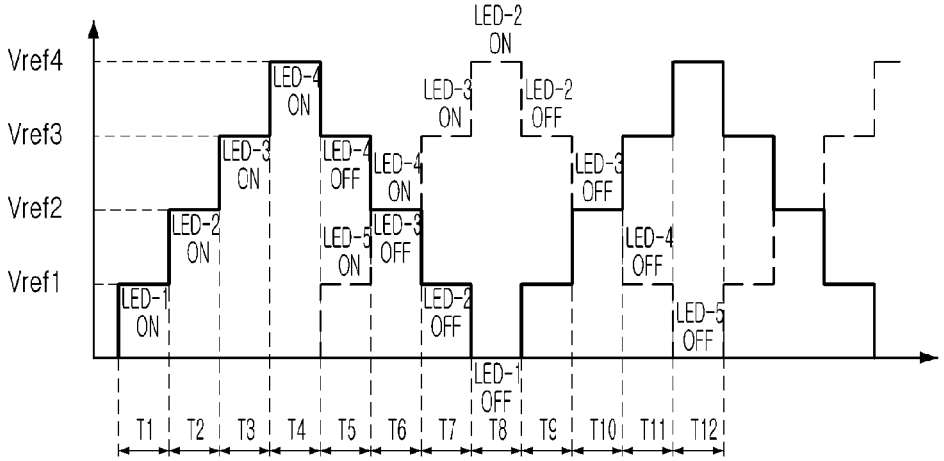

FIG. 5 is a view illustrating operations of an LED array of the LED driving apparatus according to an exemplary embodiment of the present disclosure. FIG. 5(*a*) is a view illustrating the rectified voltage Vrt and an operation of the LED array 200. FIG. 5(*b*) is a view illustrating the phase-adjusted voltage Vrtp and an operation of the LED array 200. FIG. 5(*c*) is a view illustrating a combination of the operation of the LED array 200 of FIG. 5(*a*) and the operation of the LED array 200 of FIG. 5(*b*).

Figure 6:
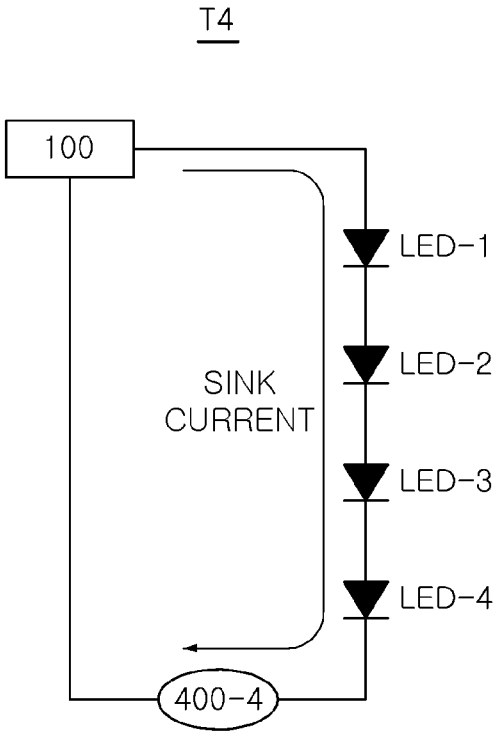
FIG. 6 is a view illustrating an operation of the LED array in a T4 section of FIG. 5.
Figure 7:
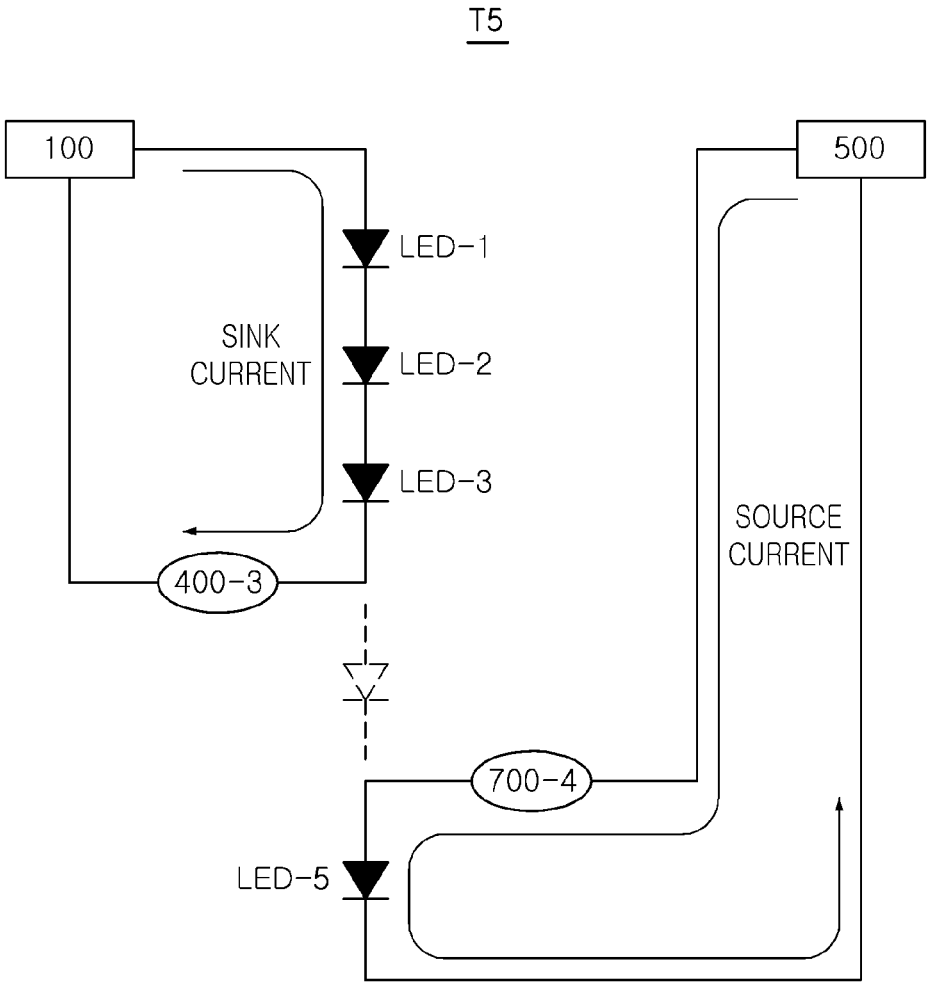
FIG. 7 is a view illustrating an operation of the LED array in a T5 section of FIG. 5.
Figure 8:
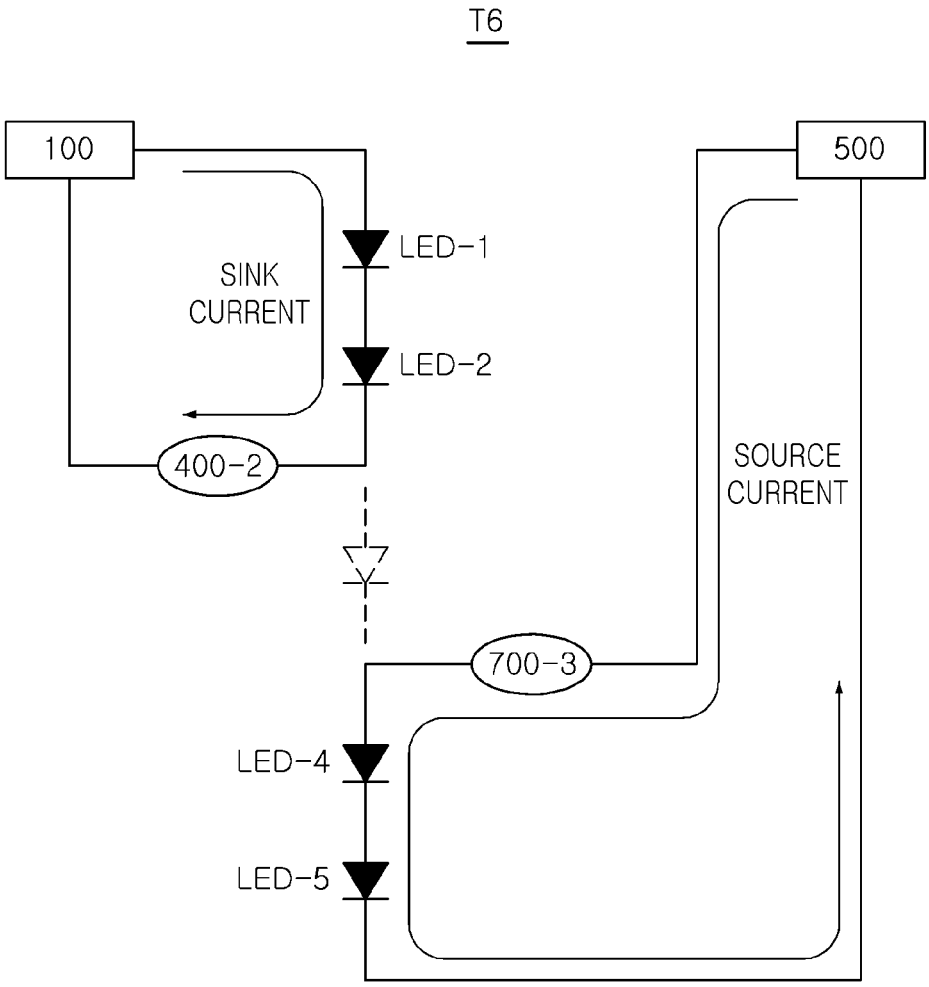
FIG. 8 is a view illustrating an operation of the LED array in a T6 section of FIG. 5.
Figure 9:
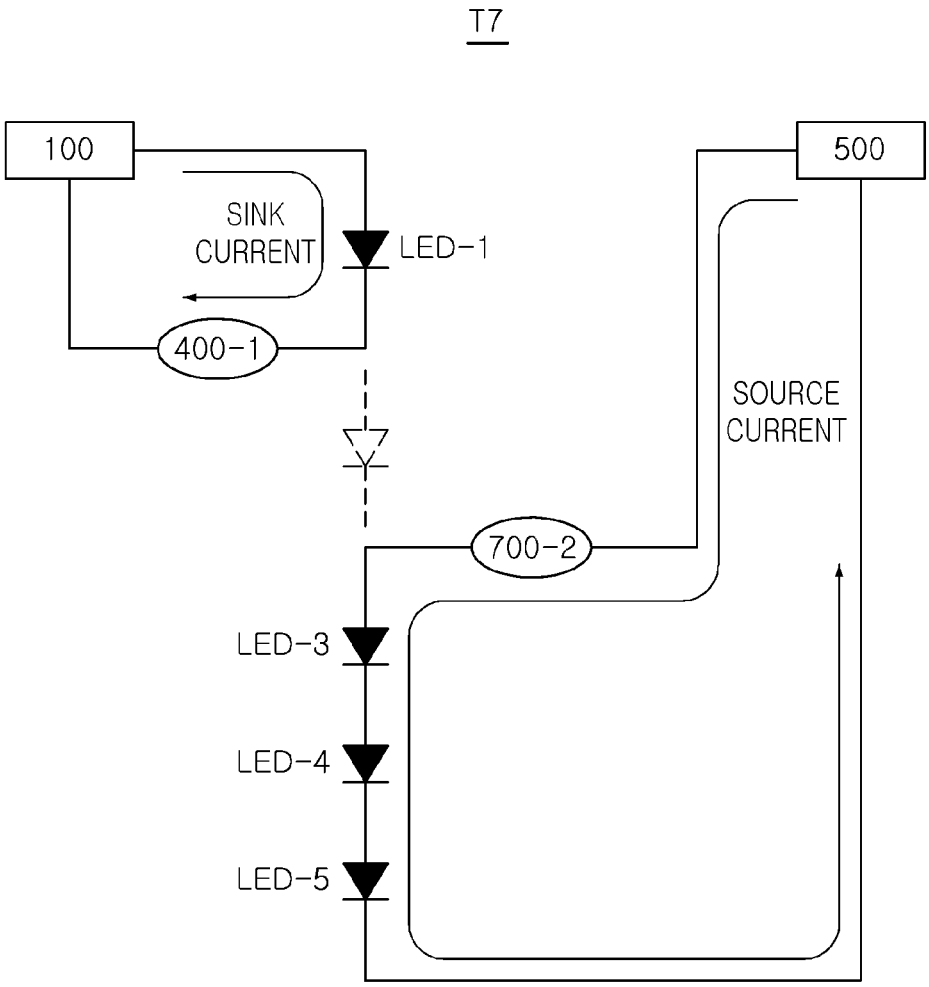
FIG. 9 is a view illustrating an operation of the LED array in a T7 section of FIG. 5.
Figure 10:
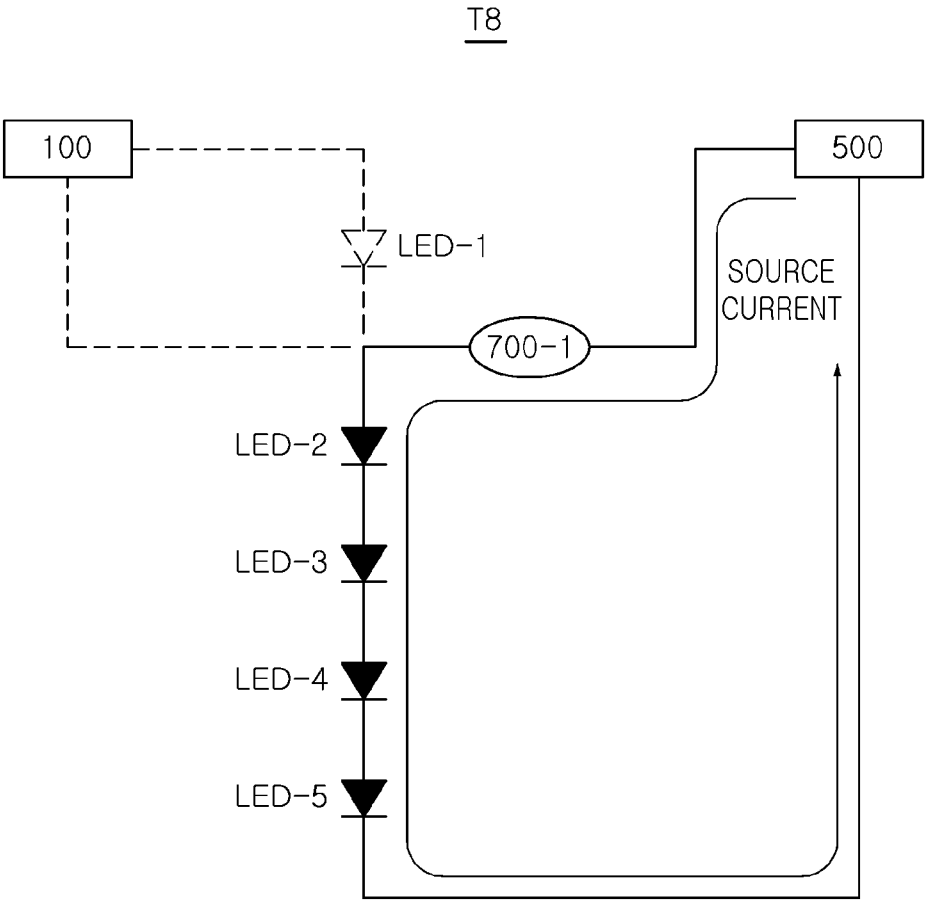
FIG. 10 is a view illustrating an operation of the LED array in a T8 section of FIG. 5.
Figure 11:
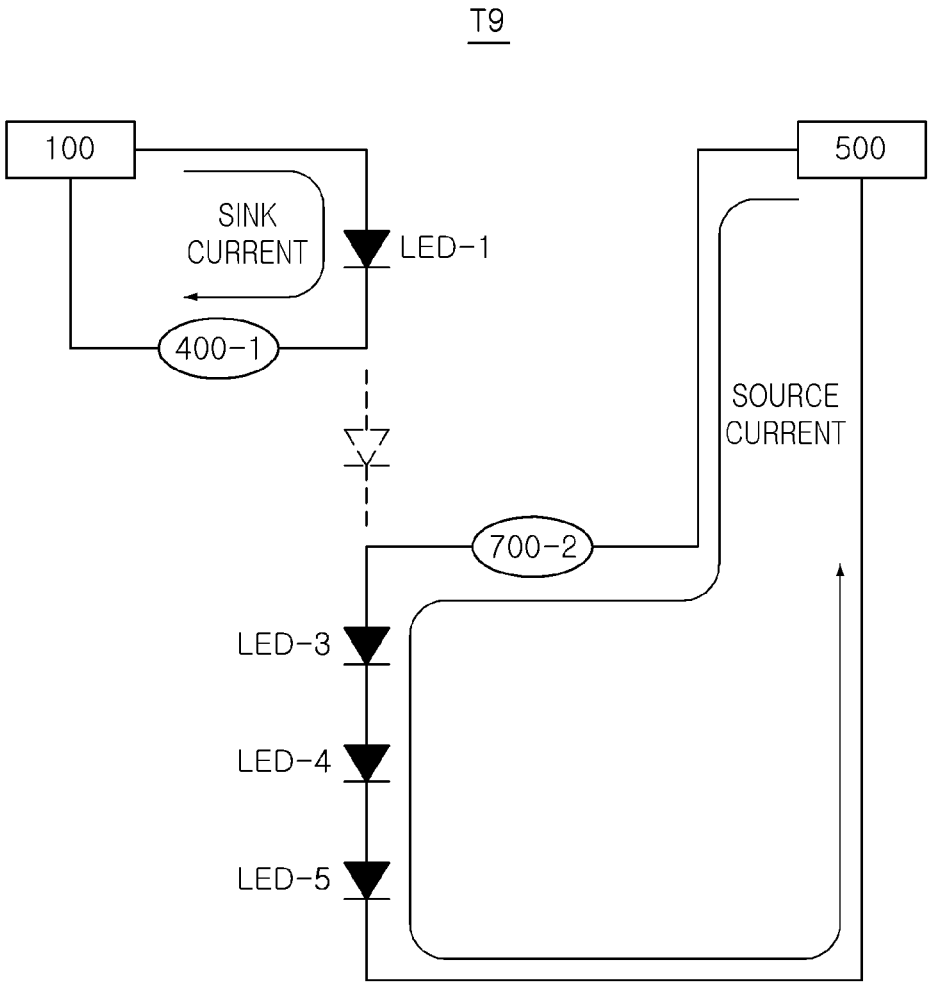
FIG. 11 is a view illustrating an operation of the LED array in a T9 section of FIG. 5.
Figure 12:
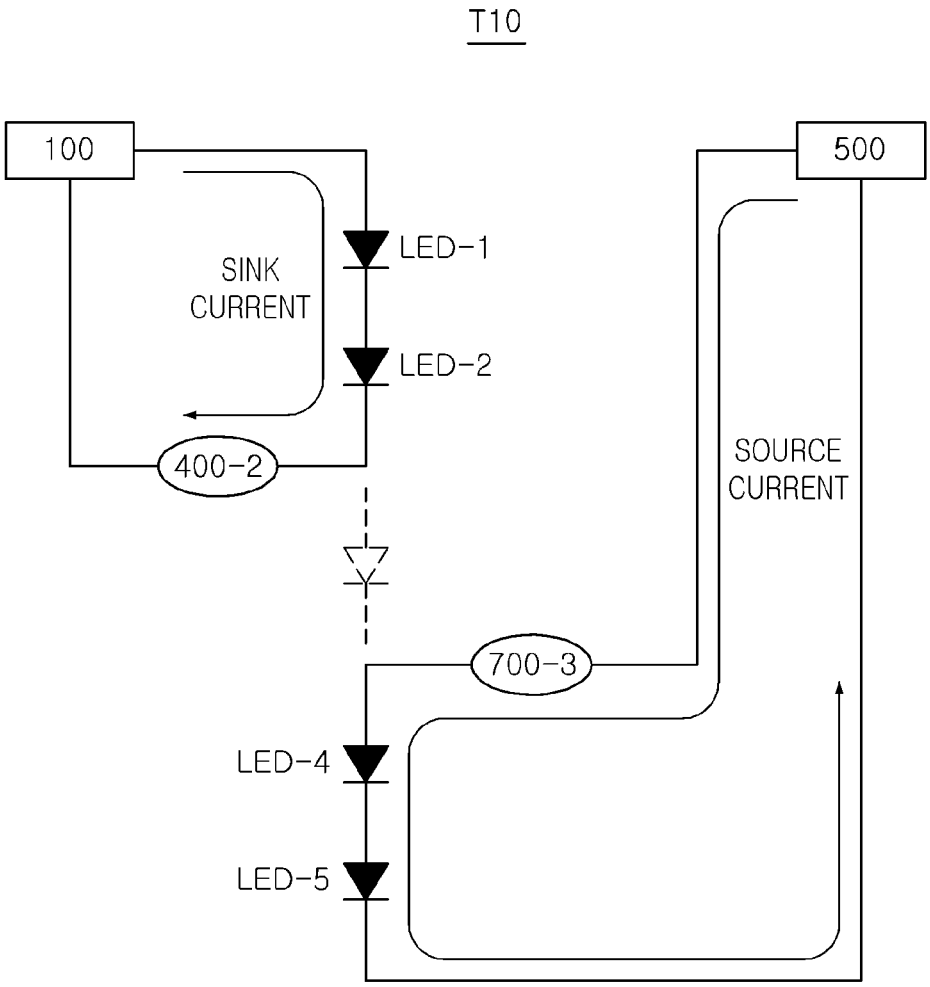
FIG. 12 is a view illustrating an operation of the LED array in a T10 section of FIG. 5.
Figure 13:
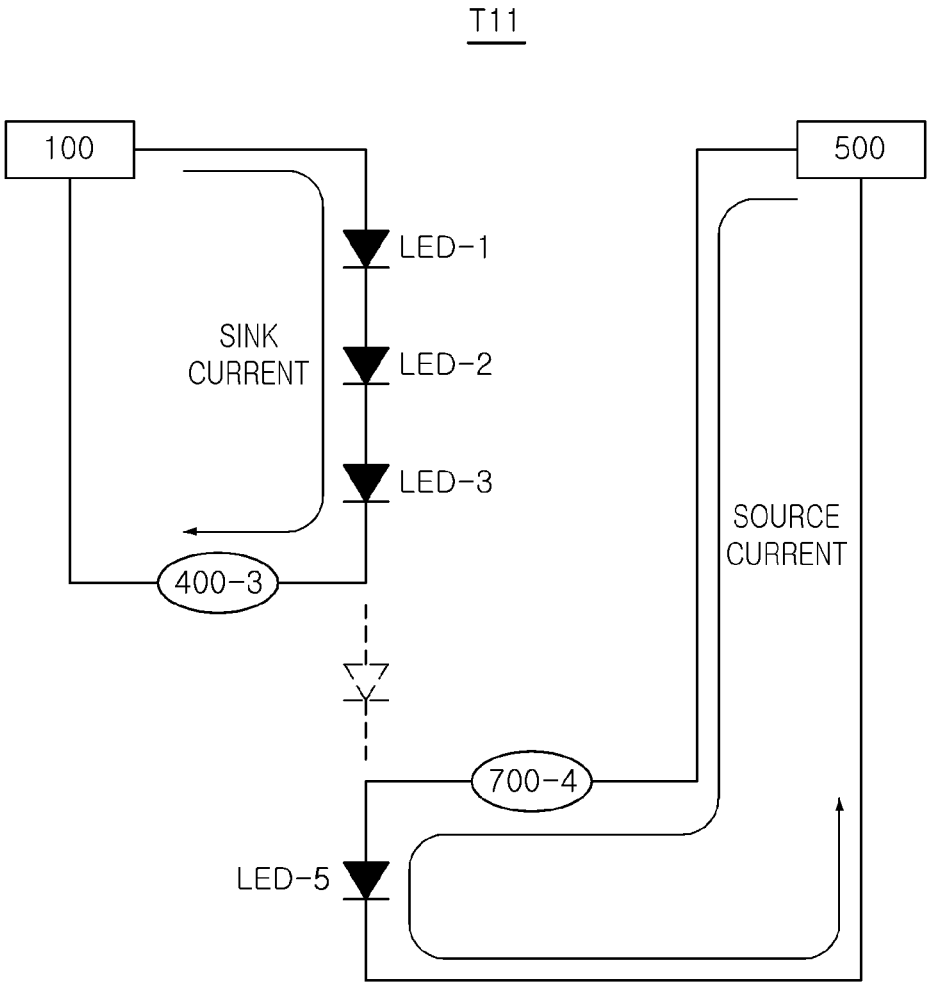
FIG. 13 is a view illustrating an operation of the LED array in a T11 section of FIG. 5.
Figure 14:
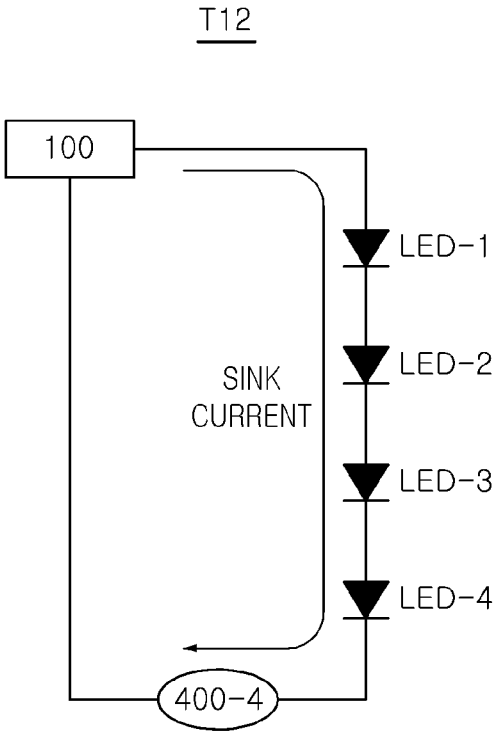
FIG. 14 is a view illustrating an operation of the LED array in a T12 section of FIG. 5.

FIG. 6 is a view illustrating an operation of the LED array in a T4 section of FIG. 5. FIG. 7 is a view illustrating an operation of the LED array in a T5 section of FIG. 5. FIG. 8 is a view illustrating an operation of the LED array in a T6 section of FIG. 5. FIG. 9 is a view illustrating an operation of the LED array in a T7 section of FIG. 5. FIG. 10 is a view illustrating an operation of the LED array in a T8 section of FIG. 5. FIG. 11 is a view illustrating an operation of the LED array in a T9 section of FIG. 5. FIG. 12 is a view illustrating an operation of the LED array in a T10 section of FIG. 5. FIG. 13 is a view illustrating an operation of the LED array in a T11 section of FIG. 5. FIG. 14 is a view illustrating an operation of the LED array in a T12 section of FIG. 5.

An example will be described with reference to FIGS. 6 through 14. In a case in which the rectified voltage Vrt is changed within a voltage range from 0V to 311V and first, second, third, and fourth reference voltages Vref1, Vref2, Vref3, and Vref4 are respectively 75V, 150V, 225V, and 300V, the rectified voltage Vrt may be gradually increased to 75V, 150V, 225V, and 300V or higher to change the first, second, third, and fourth sink path control signals S10-1 to S10-4 to ON signals one by one.

Accordingly, when the first sink path control signal S10-1 is changed to an ON signal, the first LED LED-1 of the LED array 200 is turned on. When the second sink path control signal S10-2 is changed to an ON signal, the first and second LEDs LED-1 and LED-2 of the LED array 200 are turned on. When the third sink path control signal S10-3 is changed to an ON signal, the first to third LEDs LED-1 to LED3 of the LED array 200 are turned on. When the fourth sink path control signal S10-4 is changed to an ON signal, the first to fourth LEDs LED-1 to LED-4 of the LED array 200 are turned on (please see T1 to T4 of FIG. 5).

First, when the rectified voltage Vrt is 300V or higher and the phase-adjusted voltage Vrtp is a zero voltage, the fourth sink path control signal S10-4 is changed to an ON signal by the sink path controller 300 to change the fourth sink path switch 400-4 to an ON state, and accordingly, as illustrated in FIG. 6, a sink current flows through the first to fourth LEDs LED-1 to LED-4 (please see T4 in FIGS. 6 and 5).

Next, when the rectified voltage Vrt is 225V or higher and lower than 300V, the third sink path control signal S10-3 is changed to an ON signal to change the third sink path switch 400-3 to an ON state, and accordingly, as illustrated in FIG. 7, a sink current flows through the first to third LEDs LED-1 to LED-3.

In this case, if the phase-adjusted voltage Vrtp is 75V or higher and lower than 150V, the fourth source path control signal S20-4 is changed to an ON signal by the source path controller 600 to change the fourth source path switch 700-4 to an ON state, and accordingly, as illustrated in FIG. 7, a source current flows through the fifth LED LED-5 (please see T5 of FIGS. 7 and 5).

Thereafter, when the rectified voltage Vrt is 150V or higher and lower than 225V, the second sink path control signal S10-2 is changed to an ON signal by the sink path controller 300 to change the second sink path switch 400-2 to an ON state, and accordingly, as illustrated in FIG. 8, a sink current flows through the first and second LEDs LED-1 and LED-2.

In this case, if the phase-adjusted voltage Vrtp is 150V or higher and lower than 225V, the third source path control signal S20-3 is changed to an ON signal by the source path controller 600 to change the third source path switch 700-3 to an ON state, and accordingly, as illustrated in FIG. 8, a source current flows through the fourth and fifth LEDs LED-4 and LED-5 (please see T6 of FIGS. 8 and 5).

Thereafter, when the rectified voltage Vrt is 75V or higher and lower than 150V, the first sink path control signal S10-1 is changed to an ON signal by the sink path controller 300 to change the first sink path switch 400-1 to an ON state, and accordingly, as illustrated in FIG. 9, a sink current flows through the first LED LED-1.

In this case, if the phase-adjusted voltage Vrtp is 225V or higher and lower than 300V, the second source path control signal S20-2 is changed to an ON signal by the source path controller 600 to change the second source path switch 700-2 to an ON state, and accordingly, as illustrated in FIG. 9, a source current flows through the third to fifth LEDs LED-3 to LED-5 (please see T7 of FIGS. 9 and 5).

Thereafter, when the rectified voltage Vrt is lower than 75V, all of the first to fourth sink path control signals S10-1 to S10-4 becomes OFF signal by the sink path controller 300, and thus, a sink current does not flow.

In this case, if the phase-adjusted voltage Vrtp is 300V or higher, the first source path control signal S20-1 is changed to an ON signal by the source path controller 600 to change the first source path switch 700-1 to an ON state, and accordingly, as illustrated in FIG. 10, a source current flows through the second to fifth LEDs LED-2 to LED-5 (please see T8 of FIGS. 10 and 5).

Thereafter, when the rectified voltage Vrt is 75V or higher and lower than 150V, the first sink path control signal S10-1 is changed to an ON signal by the sink path controller 300 to change the first sink path switch 400-1 to an ON state, and accordingly, as illustrated in FIG. 11, a sink current flows through the first LED LED-1.

In this case, if the phase-adjusted voltage Vrtp is 225V or higher and lower than 300V, the second source path control signal S20-2 is changed to an ON signal by the source path controller 600 to change the second source path switch 700-2 to an ON state, and accordingly, as illustrated in FIG. 11, a source current flows through the third to fifth LEDs LED-3 to LED-5 (please see T9 of FIGS. 11 and 5).

Thereafter, when the rectified voltage Vrt is 150V or higher and lower than 225V, the second sink path control signal S10-2 is changed to an ON signal by the sink path controller 300 to change the second sink path switch 400-2 to an ON state, and accordingly, as illustrated in FIG. 12, a sink current flows through the first and second LEDs LED-1 and LED-2.

In this case, if the phase-adjusted voltage Vrtp is 150V or higher and lower than 225V, the third source path control signal S20-3 is changed to an ON signal by the source path controller 600 to change the third source path switch 700-3 to an ON state, and accordingly, as illustrated in FIG. 12, a source current flows through the fourth and fifth LEDs LED-4 and LED-5 (please see T10 of FIGS. 12 and 5).

Thereafter, when the rectified voltage Vrt is 225V or higher and lower than 300V, the third sink path control signal S10-3 is changed to an ON signal by the sink path controller 300 to change the third sink path switch 400-3 to an ON state, and accordingly, as illustrated in FIG. 13, a sink current flows through the first to third LEDs LED-1 to LED-3.

In this case, if the phase-adjusted voltage Vrtp is 75V or higher and lower than 150V, the fourth source path control signal S20-4 is changed to an ON signal by the source path controller 600 to change the fourth source path switch 700-4 to an ON state, and accordingly, as illustrated in FIG. 13, a source current flows through the fifth LED LED-5 (please see T11 of FIGS. 13 and 5).

When the rectified voltage Vrt is 300V or higher and the phase-adjusted voltage Vrtp is a zero voltage, the fourth sink path control signal S10-4 is changed to an ON signal by the sink path controller 300 to change the fourth sink path switch 400-4 to an ON state, and accordingly, as illustrated in FIG. 14, a sink current flows through the first to fourth LEDs LED-1 to LED-4 (please see T12 of FIGS. 14 and 5).

As described above through examples, since four LEDs, among the five first to fifth LEDs LED-1 to LED-5, are maintained in the turned-on state regardless of a phase of the rectified voltage, flickering does not occur, uniform brightness may be constantly provided, and brightness efficiency is high on the whole. Such effects are obtained by the respective LED driving apparatus and method according to exemplary embodiments of the present disclosure.

Figure 15:
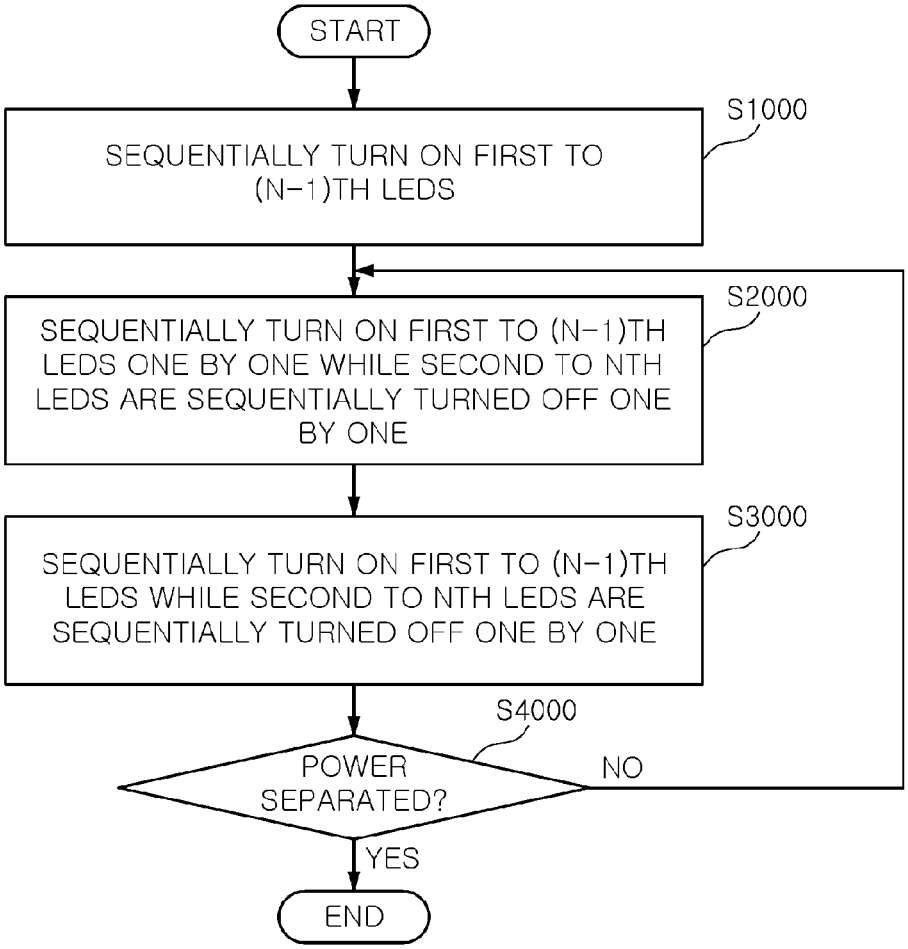
FIG. 15 is a flow chart illustrating a method of driving LEDs according to an exemplary embodiment of the present disclosure.
Figure 16:
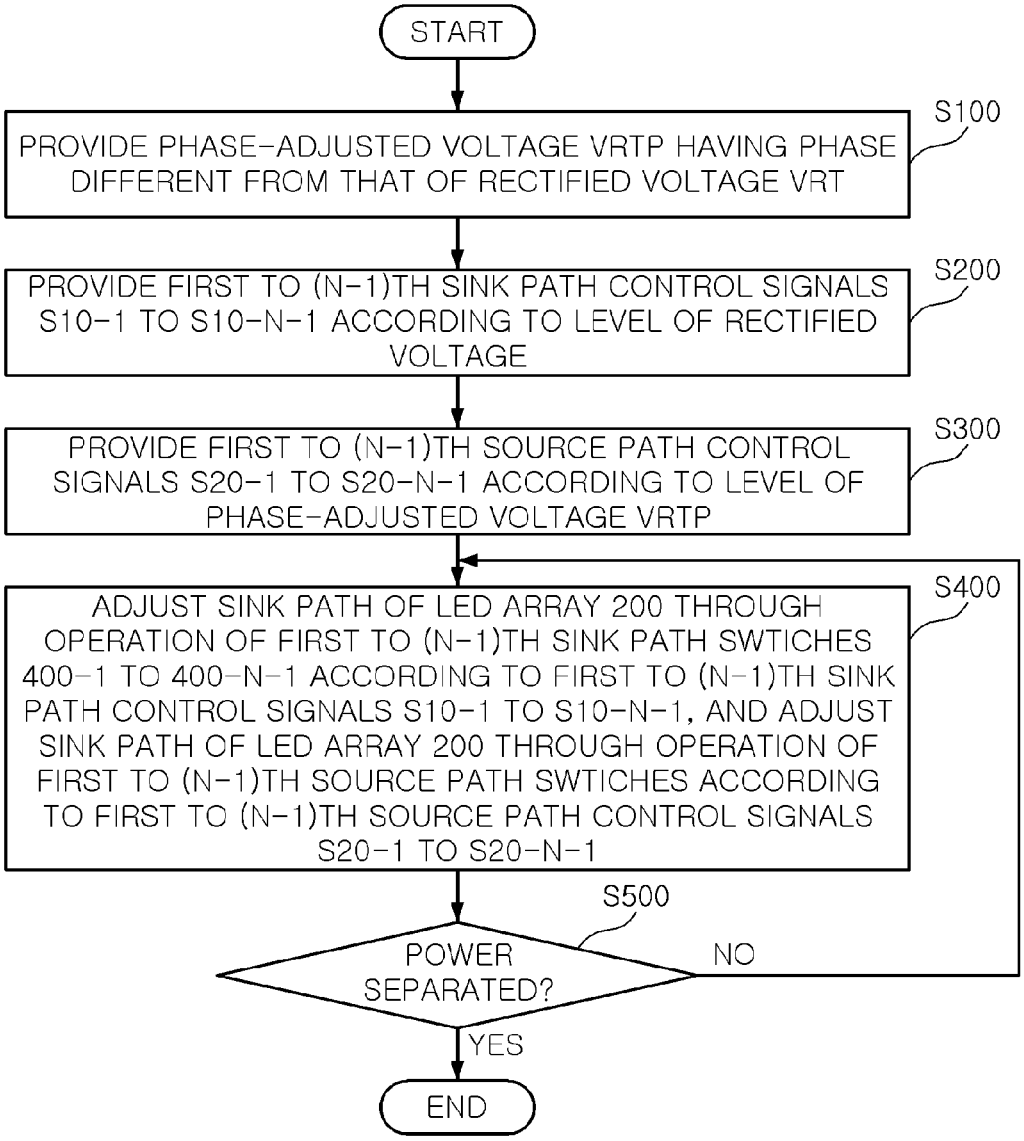
FIG. 16 is a flow chart illustrating a method of driving LEDs according to an exemplary embodiment of the present disclosure.

FIG. 15 is a flow chart illustrating a method of driving LEDs according to an exemplary embodiment of the present disclosure, and FIG. 16 is a flow chart illustrating a method of driving LEDs according to an exemplary embodiment of the present disclosure. An LED driving method according to an exemplary embodiment of the present disclosure will be described with reference to FIGS. 1 through 16.

In the following descriptions, the descriptions of operations performed with reference to FIGS. 1 through 10 may be applied as is, and accordingly, redundant detailed descriptions may be omitted in describing the LED driving method hereinafter.

Prior to describing a method for driving the LED array 200 described above with reference to FIGS. 1 through 16, the rectifying unit 100 may form a closed circuit with the first to (n−1)th LEDs LED-1 to LED-n-1, and the voltage phase controller 500 may form a closed circuit with the second to nth LEDs LED-2 to LED-n.

An LED driving method according to an exemplary embodiment of the present disclosure will be described with reference to FIGS. 1 through 15.

First, in operation 51000, as a level of the rectified voltage Vrt is gradually increased, the sink path controller 300 controls the sink path switching circuit unit 400 to sequentially turn on the first to (n−1)th LEDs LED1 to LEDn-1 one by one.

For example, as the level of the rectified voltage Vrt is gradually increased, the sink path controller 300 may control the first to (n−1)th sink path switches 400-1 to 400-n-1 included in the sink path switching circuit unit 400 to be switched on one by one in a direction from the first sink path switch 400-1 toward the (n−1)th sink path switch 400-n-1.

In this manner, as the first to (n−1)th sink path switches 400-1 to 400-n-1 are sequentially switched on, the first to (n−1)th LEDs LED1 to LEDn-1 may be sequentially turned on.

Next, in operation S2000, as the level of the rectified voltage Vrt is gradually decreased, the sink path controller 300 may control the sink path switching circuit unit 400 to sequentially turn off the (n−1)th to first LEDs LED LEDn-1 to LED1 one by one. Here, as the level of the rectified voltage Vrt is gradually decreased, the level of the phase-adjusted voltage Vrtp is gradually increased, and as the level of the phase-adjusted voltage Vrtp is gradually increased, the source path controller 600 may control the source path switching circuit unit 700 to sequentially turn on the turned-off nth to second LEDs LEDn to LED2 one by one.

For example, as the level of the rectified voltage Vrt is gradually decreased, the sink path controller 300 may control the first to (n−1)th sink path switches 400-1 to 400-n-1 included in the sink path switching circuit unit 400 to be switched off one by one in a direction from the (n−1)th sink path switch 400-n-1 toward the first sink path switch 400-1. Here, as the level of the phase-adjusted voltage Vrtp is gradually increased, the source path controller 600 may control the first to (n−1)th source path switches 700-1 to 700-n-1 included in the source path switching circuit unit 700 to be switched on one by one in a direction from the (n−1)th source path switch 700-n-1 toward the first source path switch 700-1.

In this manner, according to the switching-off operations of the first to (n−1)th sink path switches 400-n-1 to 400-1 in the direction from the (n−1)th sink path switch 400-n-1 toward the first sink path switch 400-1, the (n−1)th to first LEDs LEDn-1 to LED1 may be sequentially turned off one by one, during which, according to the switching-on operations of the first to (n−1)th source path switches 700-1 to 700-n-1 in the direction from the (n−1)th source path switch 700-n-1 toward the first source path switch 700-1, the turned-off nth to second LEDs LEDn to LED2 may be sequentially turned on one by one.

Thereafter, in operation S3000, as the level of rectified voltage Vrt is gradually increased, the level of the phase-adjusted voltage Vrtp is gradually decreased, and as the level of the phase-adjusted voltage Vrtp is gradually decreased, the source path controller 600 may control the source path switching circuit unit 700 to sequentially turn off the second to nth LEDs LED2 to LEDn one by one. Here, as the level of the rectified voltage Vrt is gradually reincreased, the sink path controller 300 may control the sink path switching circuit unit 400 to sequentially turn on the turned-off first to (n−1)th LEDs LED1 to LEDn-1 one by one.

For example, as the level of the phase-adjusted voltage Vrtp is gradually decreased, the source path controller 600 may control the first to (n−1)th source path switches 700-1 to 700-n-1 included in the source path switching circuit unit 700 to be switched off one by one in a direction from the first source path switch 700-1 toward the (n−1)th source path switch 700-n-1. Here, as the level of the rectified voltage Vrt is gradually reincreased, the sink path controller 300 may control the first to (n−1)th sink path switches 400-1 to 400-n-1 included in the sink path switching circuit unit 400 to be switched on one by one in a direction from the first sink path switch 400-1 toward the (n−1)th sink path switch 400-n-1.

In this manner, according to the switching-off operations of the first to (n−1)th source path switches 700-1 to 700-n-1 in the direction from the first source path switch 700-1 toward the (n−1)th source path switch 700-n-1, the second to nth LEDs LED2 to LEDn may be sequentially turned off one by one, during which, according to the switching-on operations of the first to (n−1)th sink path switches 400-1 to 400-n-1 in the direction from the first sink path switch 400-1 toward the (n−1)th sink path switch 400-n-1, the turned-off first to (n−1) th LEDs LED1 to LEDn-1 may be sequentially turned on one by one.

In operation S4000, when power is separated, the foregoing process may be terminated, and in the case that power is not separated, the process is returned to operation S2000 and operations S2000 and S3000 may be repeatedly performed.

An LED driving method according to an exemplary embodiment of the present disclosure will be described with reference to FIGS. 16 and 17.

First, in operation 5100, the voltage phase controller 500 may provide a phase-adjusted voltage Vrtp having a phase different from that of a rectified voltage Vrt of the rectifying unit 100.

In operation S200, the sink path controller 300 may detect a level of a rectified voltage from the rectifying unit 100 and provide first to (n−1)th sink path control signals S10-1 to S10-n-1 according to the level of the rectified voltage.

In operation S300, the source path controller 600 may detect a level of the phase-adjusted voltage Vrtp and provide first to (n−1)th source path control signals S20-1 to S20-n-1 according to the level of the phase-adjusted voltage.

In operation S400, first to (n−1)th sink path switches 400-1 to 400-n-1 included in the sink path switching circuit unit 400 and respectively connected between cathodes of the first to (n−1)th LEDs LED-1 to LED-n-1 and a ground are respectively switched on or off according to the first to (n−1)th sink path control signals S10-1 to S10-n-1 to control a sink path.

Along with such operations, the first to (n−1)th source path switches 700-1 to 700-n-1 included in the source path switching circuit unit 700 and respectively connected between anodes of the second to nth LEDs LED-2 to LED-n and the phase-adjusted voltage Vrtp terminal of the voltage phase controller 500 may be respectively switched on or off according to the first to (n−1)th source path control signals S20-1 to S20-n-1 to control a source path.

Also, in operation S400, when the ith sink path control signal S10-i is provided as an ON signal by the sink path controller 300, the ith source path control signal S20-1 is provided as an OFF signal and an (i+1)th source path control signal S20-i+1 may be provided as an ON signal by the source path controller 600.

Subsequently, when the ith sink path switch 400-i is changed to be switched on according to the ith sink path control signal S10-i, the ith source path switches 700-i may be changed to be switched off according to the ith source path control signal S20-i and the (i+1)th source path switch 700-i+1 may be changed to be switched on according to the (i+1)th source path control signal S20-i+1.

Subsequently, when the ith sink path switch 400-i is switched on to turn on the first to ith LEDs LED-1 to LED-i, among the first to (n−1)th LEDs LED-1 to LED-n-1, the (i+1)th source path switch 700-i+1 may be switched on to turn on the (i+2)th to nth LEDs LED-i+2 to LED-n.

In addition, in operation S400, in the first to (n−1)th sink path switches 400-1 to 400-n-1, according to first to (n−1)th sink path control signals S10-1 to S10-n-1, as the level of the rectified voltage from the rectifying unit 100, the first to (n−1)th sink path switches 400-1 to 400-n-1 may be changed to be switched on one by one in a direction from the first sink path switch 400-1 toward the (n−1)th sink path switch 400-n-1, and as the level of the rectified voltage from the rectifying unit 100 is redecreased, the first to (n−1)th sink path switches may be changed to be switched on one by one in a direction from the (n−1)th sink path switch 400-n-1 toward the first sink path switch 400-1.

Also, in operation S400, in the first to (n−1)th source path switches 700-1 to 700-n-1, according to first to (n−1)th source path control signals S20-1 to S20-n-1, as the level of the phase-adjusted voltage Vrtp of the voltage phase controller 500 is increased, the first to (n−1)th source path switches 700-n-1 to 700-1 may be changed to be switched on one by one in a direction from the (n−1)th source path switch 700-n-1 toward the first source path switch 700-1. As the level of the phase-adjusted voltage Vrtp from the voltage phase controller 500 is redecreased, the first to (n−1)th source path switches 700-1 to 700-n-1 may be changed to be switched on one by one in a direction from the first source path switch 700-1 toward the (n−1)th source path switch 700-n-1.

Meanwhile, in operation 5500, whether power is separated is determined, and in the case that power is not separated, operation S400 is repeatedly performed, or when power is separated, the foregoing process is terminated.

Figure 17:
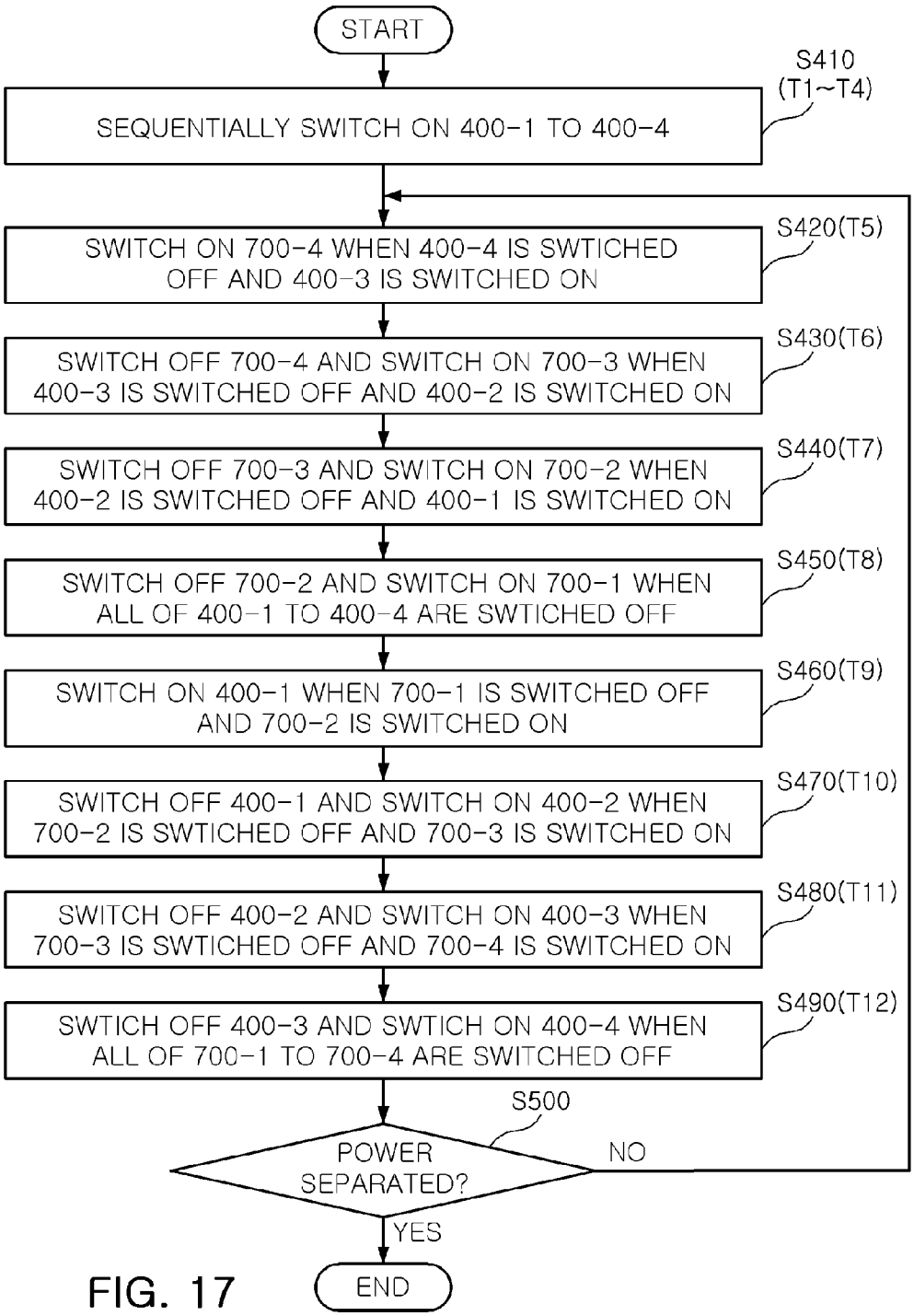
FIG. 17 is a flow chart illustrating a process of controlling sink and source paths according to an exemplary embodiment of the present disclosure.

FIG. 17 is a flow chart illustrating a process of controlling sink and source paths according to an exemplary embodiment of the present disclosure.

Referring to FIGS. 5 through 17, the rectifying unit 100 may form a closed circuit with the first to fourth LEDs LED-1 to LED-4, and the voltage phase controller 500 may form a closed circuit with the second to fifth LEDs LED-1 to LED-5.

First, in operation S410, the first to fourth sink path switches 400-1 to 400-4 may be sequentially changed to be switched on one by one by the sink path controller 300 according to a level of the rectified voltage Vrt.

In operation S420, when the fourth sink path switch 400-4 is switched off and the third sink path switch 400-3 is changed to be switched on by the sink path controller 300, the fourth source path switch 700-4 may be changed to be switched on by the source path switching circuit unit 700.

In operation S430, when the third sink path switch 400-3 is switched off and the second sink path switch 400-2 is changed to be switched on by the sink path controller 300, the fourth source path switch 700-4 may be switched off and the third source path switch 700-3 may be changed to be switched on by the source path controller 600.

In operation S440, when the second sink path switch 400-2 is switched off and the first sink path switch 400-1 is changed to be switched on by the sink path controller 300, the third source path switch 700-3 may be switched off and the second source path switch 700-2 may be changed to be switched on by the source path controller 600.

In operation S450, when all of the first to fourth sink path switches 400-1 to 400-4 are switched off by the sink path controller 300, the second source path switch 700-2 may be switched off and the first source path switch 700-1 may be changed to be switched on by the source path controller 600.

In operation S460, when the first source path switch 700-1 is switched off and the second source path switch 700-2 is changed to be switched on by the source path controller 600, the first sink path switch 400-1 may be changed to be switched on by the sink path controller 300.

In operation S470, when the second source path switch 700-2 is switched off and the third source path switch 700-3 is changed to be switched on by the source path controller 600, the first sink path switch 400-1 may be switched off and the second sink path switch 400-2 may be changed to be switched on by the sink path controller 300.

In operation S480, when the third source path switch 700-3 is switched off and the fourth source path switch 700-4 is changed to be switched on by the source path controller 600, the second sink path switch 400-2 may be switched off and the third sink path switch 400-3 may be changed to be switched on by the sink path controller 300.

In operation S490, when all of the first to fourth source path switches 700-1 to 700-4 are changed to be switched off by the source path controller 600, the fourth sink path switch 400-4 may be changed to be switched on by the sink path controller 300.

As set forth above, according to exemplary embodiments of the present disclosure, shortcomings with respect to flickering occurring when LEDs are driven using a rectified voltage may be resolved, and by turning on a fixed number of LEDs, among a plurality of LEDs included in an LED array, uniform brightness may be maintained. Also, by maintaining at least one LED in a turned-off state, among a plurality of LEDs or by maintaining a fixed number of LEDs in a turned-on state, luminous efficiency may be enhanced, relative to existing technology.

While exemplary embodiments have been shown and described above, it will be apparent to those skilled in the art that modifications and variations could be made without departing from the spirit and scope of the present disclosure as defined by the appended claims.

What is claimed is:

1. A light emitting diode (LED) driving apparatus, comprising:

a rectifying unit rectifying an alternating current (AC) voltage to provide a rectified voltage;

an LED array including at least one LED string connected to an output terminal of the rectifying unit, the LED string including first to nth LEDs connected in series;

a sink path controller providing first to (n−1)th sink path control signals according to a level of the rectified voltage;

a sink path switching circuit unit including first to (n−1)th sink path switches respectively connected to cathodes of the first to (n−1)th LEDs and a ground, each of the first to (n−1)th sink path switches performing a switching operation according to each of the first to (n−1)th sink path control signals to change a closed circuit path;

a voltage phase controller generating a phase-adjusted voltage having a phase different from that of the rectified voltage;

a source path controller providing first to (n−1)th source path control signals according to a level of the phase-adjusted voltage; and a source path switching circuit unit including first to (n−1) th source path switches respectively connected between anodes of the second to nth LEDs and a phase-adjusted voltage terminal of the voltage phase controller, each of the first to (n−1)th source path switches performing a switching operation according to each of the first to (n−1)th source path control signals to change a closed circuit path.

2. The LED driving apparatus of claim 1, wherein when the sink path controller provides the ith sink path control signal (i is a natural number between 1 to n−1) as an ON signal, the source path controller provides the ith source path control signal as an OFF signal and a (i+1)th source path control signal as an ON signal.

3. The LED driving apparatus of claim 1, wherein when an ith sink path switch is switched on to turn on an ith LED among the first to (n−1)th LEDs, an (i+1)th source path switch is switched on to turn on (i+2)th to nth LEDs.

4. The LED driving apparatus of claim 1, wherein, as the level of the rectified voltage is increased, the first to (n−1)th sink path switches are changed to be switched on one by one in a direction from the first sink path switch toward the (n−1) th sink path switch, and as the level of the rectified voltage is redecreased, the first to (n−1)th sink path switches are changed to be switched off one by one in a direction from the (n−1)th sink path switch toward the first sink path switch.

5. The LED driving apparatus of claim 1, wherein, as the level of the phase-adjusted voltage from the voltage phase controller is increased, the first to (n−1)th source path switches are changed to be switched on one by one in a direction from the (n−1)th source path switch toward the first source path switch, and as the level of the phase-adjusted voltage from the voltage phase controller is redecreased, the first to (n−1)th source path switches are changed to be switched off one by one in a direction from the first source path switch toward the (n−1)th source path switch.

6. A light emitting diode (LED) driving apparatus, comprising:

a rectifying unit rectifying an alternating current (AC) voltage to provide a rectified voltage;

an LED array including at least one LED string connected to an output terminal of the rectifying unit, the LED string including first to nth LEDs connected in series;

a sink path controller detecting a level of the rectified voltage and providing first to (n−1)th sink path control signals according to the level of the rectified voltage;

a sink path switching circuit unit including first to (n−1)th sink path switches respectively connected to cathodes of the first to (n−1)th LEDs and a ground, each of the first to (n−1)th sink path switches performing a switching operation according to each of the first to (n−1)th sink path control signals to change a closed circuit path;

a voltage phase controller adjusting a phase of the rectified voltage to provide a phase-adjusted voltage;

a source path controller detecting a level of the phase-adjusted voltage from the voltage phase controller and providing first to (n−1)th source path control signals according to the level of the phase-adjusted voltage; and a source path switching circuit unit including first to (n−1) th source path switches respectively connected between anodes of the second to nth LEDs and a phase-adjusted voltage terminal of the voltage phase controller, each of the first to (n−1)th source path switches performing a switching operation according to each of the first to (n−1)th source path control signals to change a closed circuit path, wherein the rectifying unit forms a closed circuit with the first to (n−1)th LEDs and the voltage phase controller forms a closed circuit with the second to nth LEDs, and when the ith sink path switch is switched on to turn on the ith LED among the first to (n−1)th LEDs, an (i+1)th source path switch is switched on to turn on an (i+2)th to nth LEDs.

7. The LED driving apparatus of claim 6, wherein as the level of the rectified voltage is increased, the first to (n−1)th sink path switches are changed to be switched on one by one in a direction from the first sink path switch toward the (n−1) th sink path switch, and as the level of the rectified voltage is redecreased, the first to (n−1)th sink path switches are changed to be switched off one by one in a direction from the (n−1)th sink path switch toward the first sink path switch.

8. The LED driving apparatus of claim 6, wherein as the level of the phase-adjusted voltage from the voltage phase controller is increased, the first to (n−1)th source path switches are changed to be switched on one by one in a direction from the (n−1)th source path switch toward the first source path switch, and as the level of the phase-adjusted voltage of the voltage phase controller is redecreased, the first to (n−1)th source path switches are changed to be switched off one by one in a direction from the first source path switch toward the (n−1)th source path switch.

9. A method of driving a light emitting diode (LED) array including at least one LED string connected to an output terminal of a rectifying unit providing a rectified voltage, the LED string including first to nth LEDs connected in series, the method comprising:

a first operation in which, as a level of the rectified voltage is gradually increased, a sink path controller controls a sink path switching circuit to sequentially turn on the first to (n−1)th LEDs one by one;

a second operation in which, as the level of the rectified voltage is gradually decreased, the sink path controller controls the sink path switching circuit unit to sequentially turn off the (n−1)th to first LEDs one by one, during which, as the level of the rectified voltage is gradually decreased, a level of a phase-adjusted voltage is gradually increased, and as the level of the phase-adjusted voltage is gradually increased, a source path controller controls a source path switching circuit unit to sequentially turn on the turned-off nth to second LEDs one by one;

a third operation in which, as the level of the rectified voltage is gradually increased, the level of the phase-adjusted voltage is gradually decreased, and as the level of the phase-adjusted voltage is gradually lowered, the source path controller controls the source path switching circuit unit to sequentially turn off the second to nth LEDs one by one, during which, as the level of the rectified voltage is gradually reincreased, the sink path controller controls the sink path switching circuit unit to sequentially turn on the turned-off first to (n−1)th LEDs one by one; and a fourth operation in which when power is separated, the process is terminated, and in the case that power is not separated, the process is returned to the second operation, and second and third operations are repeatedly performed.

10. The method of claim 9, wherein, in the first operation, as the level of the rectified voltage is gradually increased, the sink path controller controls the first to (n−1)th sink path switches included in the sink path switching circuit unit to be switched on one by one in a direction from the first sink path switch toward the (n−1)th sink path switch.

11. The method of claim 9, wherein, in the second operation, as the level of the rectified voltage is gradually decreased, the sink path controller controls the first to (n−1)th sink path switches included in the sink path switching circuit unit to be sequentially switched off in a direction from the (n−1)th sink path switch toward the first sink path switch, during which, as the level of the phase-adjusted voltage is gradually increased, the source path controller controls the first to (n−1)th source path switches included in the source path switching circuit unit to be switched on one by one in a direction from the (n−1) source path switch toward the first source path switch.

12. The method of claim 9, wherein, in the third operation, as the level of the phase-adjusted voltage is gradually decreased, the source path controller controls the first to (n−1)th source path switches included in the source path switching circuit unit to be switched off one by one in a direction from the first source path switch toward the (n−1)th source path switch, during which, as the level of the rectified voltage is gradually reincreased, the sink path controller controls the first to (n−1)th sink path switches included in the sink path switching circuit unit to be switched on one by one in a direction from the first sink path switch toward the (n−1)th sink path switch.

13. A method of driving a light emitting diode (LED) array including at least one LED string connected to an output terminal of a rectifying unit providing a rectified voltage, the LED string including first to nth LEDs connected in series, the method comprising:

generating, by a voltage phase controller, a phase-adjusted voltage having a phase different from that of the rectified voltage;

detecting, by a sink path controller, a level of the rectified voltage and providing first to (n−1)th sink path control signals according to the level of the rectified voltage;

detecting, by a source path controller, a level of the phase-adjusted voltage from the voltage phase controller and providing first to (n−1)th source path control signals according to the level of the phase-adjusted voltage; and switching on or off first to (n−1)th sink path switches included in a sink path switching circuit unit and respectively connected between cathodes of the first to (n−1)th LEDs and a ground, according to the first to (n−1)th sink path control signals, respectively, to control a sink path, and switching on or off first to (n−1)th source path switches included in a source path switching circuit unit and respectively connected between anodes of the second to nth LEDs and a phase-adjusted voltage terminal of the voltage phase controller, according to the first to (n−1)th source path control signals, respectively, to control a source path.

14. The method of claim 13, wherein, in the controlling of the sink and source paths, when the sink path controller provides the ith sink path control signal 9*i* is a natural number between 1 to n−1) as an ON signal, the source path controller provides the ith source path control signal as an OFF signal and an (i+1)th source path control signal as an ON signal.

15. The method of claim 13, wherein, in the controlling of the sink and source paths, when the ith sink path switch is switched on to turn on the first to ith LEDs, among the first to (n−1)th LEDs, the (i+1)th source path switch is switched on to turn on the (i+2)th to nth LEDs.

16. The method of claim 13, wherein, in the controlling of the sink and source paths, as the level of the rectified voltage is increased, the first to (n−1)th sink path switches are changed to be switched on one by one in a direction from the first sink path switch toward the (n−1)th sink path switch, and as the level of the rectified voltage is redecreased, the first to (n−1)th sink path switches are changed to be switched on one by one in a direction from the (n−1)th sink path switch toward the first sink path switch.

17. The method of claim 13, wherein, in the controlling of the sink and source paths, as the level of the phase-adjusted voltage from the voltage phase controller is increased, the first to (n−1)th source path switches are changed to be switched on one by one in a direction from the (n−1)th source path switch toward the first source path switch, and as the level of the phase-adjusted voltage from the voltage phase controller is redecreased, the first to (n−1)th source path switches are changed to be switched on in a direction from the first source path switch toward the (n−1)th source path switch.

18. A method of driving a light emitting diode (LED) array including at least one LED string connected to an output terminal of a rectifying unit providing a rectified voltage, the LED string including first to nth LEDs connected in series, the method comprising:

generating, by a voltage phase controller, a phase-adjusted voltage having a phase different from that of the rectified voltage;

detecting, by a sink path controller, a level of the rectified voltage and providing first to (n−1)th sink path control signals according to the level of the rectified voltage;

detecting, by a source path controller, a level of the phase-adjusted voltage from the voltage phase controller and providing first to (n−1)th source path control signals according to the level of the phase-adjusted voltage; and switching on or off first to (n−1)th sink path switches included in a sink path switching circuit unit and respectively connected between cathodes of the first to (n−1)th LEDs and a ground, according to the first to (n−1)th sink path control signals, respectively, to control a sink path, and switching on or off first to (n−1)th source path switches included in a source path switching circuit unit and respectively connected between anodes of the second to nth LEDs and a phase-adjusted voltage terminal of the voltage phase controller, according to the first to (n−1)th source path control signals, respectively, to control a source path, wherein when the ith sink path switch (i is a natural number between 1 to n−1) connected to a cathode of the ith LED among the first to (n−1)th LEDs is changed to be switched on, the (i+1)th source path switch is changed to be switched on.

19. The method of claim 18, wherein, in the controlling of the sink and source paths, as the level of the rectified voltage is increased, the first to (n−1)th sink path switches are changed to be switched on one by one in a direction from the first sink path switch toward the (n−1)th sink path switch, and as the level of the rectified voltage is redecreased, the first to (n−1)th sink path switches are changed to be switched on one by one in a direction from the (n−1)th sink path switch toward the first sink path switch.

20. The method of claim 18, wherein, in the controlling of the sink and source paths, as the level of the phase-adjusted voltage from the voltage phase controller is increased, the first to (n−1)th source path switches are changed to be switched on one by one in a direction from the (n−1)th source path switch toward the first source path switch, and as the level of the phase-adjusted voltage from the voltage phase controller is redecreased, the first to (n−1)th source path switches are changed to be switched on in a direction from the first source path switch toward the (n−1)th source path switch.

* * * * *